US006697038B2

(12) United States Patent
Morii

(10) Patent No.: US 6,697,038 B2
(45) Date of Patent: Feb. 24, 2004

(54) SIGNAL TRANSFER SYSTEM, SIGNAL TRANSFER APPARATUS, DISPLAY PANEL DRIVE APPARATUS, AND DISPLAY APPARATUS

(75) Inventor: Hideki Morii, Taki-gun (JP)

(73) Assignee: Sharp Kabushiki Kaisha, Osaka (JP)

( * ) Notice: Subject to any disclaimer, the term of this patent is extended or adjusted under 35 U.S.C. 154(b) by 354 days.

(21) Appl. No.: 09/872,735

(22) Filed: Jun. 1, 2001

(65) Prior Publication Data

US 2001/0048415 A1 Dec. 6, 2001

(30) Foreign Application Priority Data

Jun. 1, 2000 (JP) ..... 2000-165132
Mar. 23, 2001 (JP) ..... 2001-086327

(51) Int. Cl.[7] ..... G09G 3/36

(52) U.S. Cl. ..... 345/96; 345/204; 345/209; 345/100

(58) Field of Search ..... 345/87, 92, 98, 345/100, 96, 204, 209, 211–213

(56) References Cited

U.S. PATENT DOCUMENTS 4,408,201 A * 10/1983 Harada ..... 340/784
4,684,849 A * 8/1987 Otsuka et al. ..... 315/169.4
5,761,097 A * 6/1998 Palermo ..... 364/569
5,955,904 A * 9/1999 Kawasaki ..... 327/156
6,040,816 A * 3/2000 Uchino ..... 345/99
6,201,523 B1 * 3/2001 Akiyama et al. ..... 345/96
6,239,781 B1 * 5/2001 Fujisawa ..... 345/147
6,348,915 B1 * 2/2002 Yamashita et al. ..... 345/204
6,362,805 B1 * 3/2002 Jeong ..... 345/99
6,437,775 B1 * 8/2002 Hanari ..... 345/204
6,501,455 B1 * 12/2002 Nakamura ..... 345/96

FOREIGN PATENT DOCUMENTS

JP 10-153760 6/1998

* cited by examiner

*Primary Examiner*—Richard Hjerpe
*Assistant Examiner*—Kimnhung Nguyen
(74) *Attorney, Agent, or Firm*—David G. Conlin; William J. Daley, Jr.; Edwards & Angell LLP

(57) ABSTRACT

A plurality of signal input-output sections are connected with each other in a cascade manner. In each signal input-output section, an input latch circuit divides a data signal into 2 channels in accordance with the first clock signal, and an output latch circuit returns the data signal that has been divided into 2 channels to 1 channel in accordance with the second clock signal so as to be outputted to the signal input-output section of the next stage. The inputted first basic clock is outputted to the signal input-output section of the next stage as the second basic clock, and the inputted second basic clock is outputted to the signal input-output section of the next stage as the first basic clock. This allows to ensure the data sampling margin even when the data signal should be transferred at a faster speed, and also allows to suppress the problem of the EMI.

30 Claims, 23 Drawing Sheets

EVEN
CKAin
CKBin
LSin
DATAin
SPin
10
1ci
2ci
4li
3di
5si
D
SPD
CKAi
INPUT LATCH CIRCUIT
6Li
Q1
Q2
SPQ
CONTROL LOGIC SECTION
7
SPD
CKAo
OUTPUT LATCH CIRCUIT
6Lo
CKBo
Y
SPQ
1co
2co
4lo
3do
5so
CKAout
CKBout
LSout
DATAout
SPout

SIGNAL TRANSFER SYSTEM, SIGNAL TRANSFER APPARATUS, DISPLAY PANEL DRIVE APPARATUS, AND DISPLAY APPARATUS

FIELD OF THE INVENTION

The present invention relates to a signal transfer system having a plurality of signal input-output sections that are connected with each other in a cascade manner, a display panel drive apparatus, and a display apparatus using such a display panel drive apparatus, the respective system and apparatuses being provided in a drive apparatus of a liquid crystal display apparatus, for example.

BACKGROUND OF THE INVENTION

Recently, a liquid crystal display apparatus of an active matrix type has been widely used as a display apparatus for a personal computer of such as a desk top type or a notebook type or as every kind of monitor. The liquid crystal display apparatus of an active matrix type is provided with an active matrix substrate on which a plurality of pixels electrodes are provided in a matrix manner, an opposing substrate on which an opposing electrode is provided, and a liquid crystal layer provided between the active matrix substrate and the opposing substrate.

The active matrix substrate is provided with switching devices such as TFTs (Thin Film Transistors) for selectively driving the pixel electrodes. The switching devices are connected with the respective pixel electrodes. The TFT has a gate electrode that is connected with a gate bus line and a source electrode that is connected with a source bus line. The gate bus line and the source bus line are provided so as to extend orthogonal to each other around the respective pixel electrodes that are provided in a matrix manner. When the gate signal is inputted via the gate bus line, the TFT is driven and controlled, and concurrently, a data signal (display signal) is inputted into the pixel electrode via the TFT during the driving of the TFT in response to a signal sent via the source bus line. This allows that an electric field is generated between the pixel electrode and the opposing electrode. The electric field causes the alignment state to change so as to display the image.

Each source bus line is connected with the source driver which outputs the data signal to each source bus line. The source drivers are provided in accordance with the number of the source bus lines. Each source driver receives the data signal to be sent to the source bus line associated with the source driver via a timing controller.

The data transfer to the source driver is carried out in response to the signals such as a start pulse input signal SPin, a data signal DATA, and a start pulse output signal SPout. FIG. 17 is a time chart showing the respective signals in the nth source driver n and the (n+1)th source driver n+1. This example deals with the case where each source driver has 300 outputs. When it is assumed that the data of each color component of R, G, and B for 1 block are fetched, it appears that the sampling of the data corresponding to 100 clocks is carried out with respect to a single source driver.

After receiving the start pulse input signal SPin, each source driver starts to carry out the data sampling in response to the next clock. When the data sampling corresponding to 100 clocks is completed, the start pulse output signal SPout is sent to the source driver of the next stage. The start pulse output signal SPout is sent to the source driver of the next stage as a start pulse input signal SPin.

This allows the source driver of the next stage to carry out a data sampling in a manner similar to the above-described procedure.

As to the entire liquid crystal panel, in the case of SVGA having 800×600 pixels, 8(800÷100(clocks)) source drivers are connected with each other in a cascade manner. FIG. 18 is an explanatory diagram showing the schematic connecting state of the source drivers STAB1 through STAB8. As shown in FIG. 18, the data signal DATA and the latch strobe signal LS are sent to the respective source drivers STAB1 through STAB8 in parallel. The start pulse input signal SPin is sent to the source driver STAB1. The source driver STAB2 and its succeeding source drivers receive the start pulse SPout from the source driver of the previous stage as the start pulse input signal SPin.

In the case where the data samplings of the source drivers STAB1 through STAB8 are completed in the above-described manner, when the latch strobe signal is sent to the respective source drivers STAB1 through STAB8, an analog voltage corresponding to all the sampling data that correspond to 1 line is outputted from the output terminals of the respective source drivers STAB1 through STAB8. A voltage corresponding to the data signal is applied to each of the pixel electrodes on the line that has been selected by the gate signal.

In the timing chart shown in FIG. 17, the operating frequency of the start pulse input signal SPin the data signal DATA and the start pulse output signal SPout is coincident with the clock frequency fck. For example, in the case of SVGA, the clock frequency fck is equal to 40 MHz (clock period Tck=1/fck=25(ns)) according to the VESA (The Video Electronics Standards Association) standard, while in the case of XGA, the clock frequency fck is equal to 65 MHz (clock period Tck=15.38(ns)).

FIG. 19 shows the timing charts of the clock signal and the data signal DATA, respectively. Note that it is assumed that the data sampling is carried out in synchronization with the rising (see time Tu in FIG. 19) of the clock signal. During the time period between the time that is 1.5(ns) to the time Tu and the time when 1(ns) is elapsed after the time Tu, it is necessary that the data signal DATA be settled. Unless otherwise, it is not possible to correctly carry out the data sampling. The above-described time 1.5(ns) is referred to as a data setup time tsu, and the time 1(ns) is referred to as a data hold time th.

FIGS. 20(*a*) and 20(*b*) show examples of time charts of the relation between the clock signal and 1 bit of the data. In FIG. 20(*a*), at the time that is 0.5(ns) to the rising of the clock signal, the 1 bit of the data falls down to "L" from "H". In this case, since the data changes from "H" to "L" within the data setup time tsu=1.5(ns), it is not possible to correctly carry out the data sampling.

In contrast, in FIG. 20(*b*), at the time that is 3(ns) to the rising of the clock signal, the 1 bit of the data falls down to "L" from "H". In this case, since the data changes from "H" to "L" prior to reaching the data setup time tsu=1.5(ns), the sampling is made to the "L" of the data.

As is clear from the foregoing description, when the sampling is carried out with respect to the data in synchronization with the rising of the clock signal, the time period in which the data can be changed, i.e., the data sampling margin is indicated by the oblique line shown in FIG. 21. Namely, the data sampling margin corresponds to the period between the time when time th (the data hold time th) is elapsed after the rising of the clock signal and the time that is tsu (the data setup time) to the rising of the next clock signal.

For example, when it is assumed that the duty ratio of the clock signal is 50 percent, since the clock period Tck is equal to 25(ns), the data sampling margin is 22.5(ns)(=Tck−tsu−th=25(ns)−1.5(ns)−1(ns)) in the case of SVGA. The data sampling margin is 12.88(ns)(=Tck−tsu−th=15.38(ns)−1.5(ns)−1(ns)) in the case of XGA because the clock period Tck is equal to 15.38(ns).

Further, in actual, it takes more time for the clock signal and the data signal to rise up or fall down and it is necessary to consider the time required for the data signal to fall down to a threshold voltage (for example, 0.3×VCC) so as to be recognized to be "L" or the data signal to rise up to a threshold voltage (for example, 0.7×VCC) so as to be recognized to be "H". This results in that the time differences A and B when the time required for the above-mentioned rising and falling is not considered becomes longer the time differences A' and B' when the time required for the above-mentioned rising and falling is considered (see FIG. 22). This causes the data sampling margin to be further reduced.

In order to increase the data sampling margin so as to address the deficiency, it may be contrived to make the risings and failings of the clock signal and the data signal faster, respectively. However, this causes each wave form of the signals to rapidly change, thereby resulting in that the higher harmonic wave components increase in the clock signal and the data signal. Accordingly, this invites that the EMI (Electromagnetic Interference) becomes worse.

Further, according to the structure shown in FIG. 18, the data signal DATA is connected in parallel with all the source drivers STAB1 through STAB8 via a single wiring. This causes to generate the wiring resistance and wiring capacity due to the wiring extending from the source driver STAB1 to STAB8. The wiring resistance and wiring capacity affect the data signal, more specifically, the data signal receives the affections such as the RC delay and the reflection. This causes the data signal to be sent to the source driver with being deviated from the originally inputted timing. This also causes the data sampling margin to be reduced.

As to the problem of the delay in the data signal due to the resistance across the wire and the capacity across the wire, the following method such as the self-transfer method or the data transfer method. According to the self-transfer method, when transferring the data signal from the timing controller to the respective source drivers, the source drivers are connected with each other in a cascade manner so as to carry out the data transfer. The following description deals with the data transfer based on the self-transfer method with reference to the structure disclosed in, for example, Japanese unexamined patent publication No. 10-153760 (publication date: Jun. 9, 1998).

FIG. 23 is a block diagram showing the schematic structure of the input-output sections with respect to a single basic clock signal CLK in the self-transfer method. As shown in FIG. 23, in response to a single basic clock signal CLK (1 bit), the control signals such as a data signal DATA (18 bits), an LS signal, and an SP signal are sent from a latch circuit 51 to a control logic section 52. Similarly, in response to the single basic clock signal CLK (1 bit), a data signal DATA (18 bits), an LS signal, and an SP signal are sent from a latch circuit 53 to the source driver of the next stage (not shown) that is connected with the previous source driver.

A clock cycle regulator 54 is constituted by a circuit for compensating the clock duty ratio such as a PLL and a DLL. Even when the clock signal is connected with each other in a multiple stage manner by the clock cycle regulator 54, the duty ratio of the clock signal is fixed, thereby ensuring to stably transfer the data.

However, the foregoing structure has the following problems. First, since the structure requires the clock cycle regulator 54, circuits to be required increase. This causes the size of the chip to become bulky. This raises the problems that the cost for the source driver becomes great and the size of the glass substrate becomes large due to the fact that the length of the short sides of the driver chip becomes long when carrying out the mounting based on the COG (Chip On Glass) mounting method.

For example, when adopting a module having the XGA resolution as the liquid crystal display apparatus, the frequency of the clock signal becomes 65 MHz according to the VESA standard. As described earlier, the data sampling margin becomes very severe. As the resolution further improves, the data sampling margin becomes more severe, accordingly. Under the circumstances, if it is intended to secure the data sampling margin by making the risings and failings of the clock signal and the data signal change rapidly, the problem of the EMI occurs as described earlier.

SUMMARY OF THE INVENTION

The present invention is made in view of the foregoing circumstances, and its object is to provide a signal transfer system, a display panel drive apparatus, and a display apparatus, each having a plurality of signal input-output sections that are connected with each other in a cascade manner in which the data sampling margin can be secured even when the transfer speed of the data signal is fast, and can suppress the affections of the EMI.

In order to achieve the object, a signal transfer system in accordance with the present invention is provided with a plurality of signal input-output sections that are connected with each other in a cascade manner, in which the signal input-output section of a first stage receives a plurality of signals and consecutively transfers the signals to the signal input-output sections of the following stages in accordance with self-transfer method, characterized in that wherein the signal input-output section includes: (a) first and second clock input sections that receive first and second clock signals, respectively, from the signal input-output section of a previous stage; (b) first and second clock output sections that invert and output the first and second clock signals to the signal input-output section of a next stage; (c) a data input section that receives a data signal from the signal input-output section of the previous stage in accordance with the first clock signal that has been inputted to the first clock input section; and (d) a data output section that outputs the data signal to the signal input-output section of the next stage in accordance with the second clock signal that has been inputted to the second clock input section.

With the arrangement, in each signal input-output section, the data signal is inputted to the data input section in accordance with the first clock signal and is outputted to the data output section in accordance with the second clock signal. This allows to output a stable data signal to the signal input-output section of the next stage even when the data signal, that has been inputted in accordance with the first clock signal, is easy to receive the affections such as the wiring capacity in the signal input-output section in the case where the data signal is transferred faster, because the data signal is outputted in accordance with the second clock signal. Thus, it is possible to guarantee the specification of the timing for fetching the data in the signal input-output section.

Since the first and second output sections invert and output the respective first and second clock signals to the signal input-output section of the next stage, the fluctuation of the duty ratio occurred when the first and second clock signals pass through each signal input-output section is canceled by the neighboring signal input-output sections. This allows to compensate the duty ratio of the clock signals in the multiple cascade connections, thereby enabling that the transfer system operates at a higher frequency.

Another signal transfer system in accordance with the present invention is provided with a plurality of signal input-output sections that are connected with each other in a cascade manner, in which the signal input-output section of a first stage receives a plurality of signals and consecutively transfers the signals to the signal input-output sections of the following stages in accordance with self-transfer method, characterized in that the signal input-output section includes: (a) first and second clock input sections that receive first and second clock signals, respectively, from the signal input-output section of a previous stage; (b) a data input section that receives a data signal from the signal input-output section of a previous stage in accordance with the first clock signal that has been inputted to the first clock input section; (c) a data output section that outputs the data signal to the signal input-output section of a next stage in accordance with the second clock signal that has been inputted to the second clock input section; (d) a first clock output section that outputs the second clock signal to the signal input-output section of the next stage as the first clock signal; and (e) a second clock output section that outputs the first clock signal to the signal input-output section of the next stage as the second clock signal.

With the arrangement, in each signal input-output section, the data signal is inputted to the data input section in accordance with the first clock signal and is outputted to the data output section in accordance with the second clock signal. This allows to output a stable data signal to the signal input-output section of the next stage even when the data signal, that has been inputted in accordance with the first clock signal, is easy to receive the affections such as the wiring capacity in the signal input-output section in the case where the data signal is transferred faster, because the data signal is outputted in accordance with the second clock signal. Thus, it is possible to guarantee the specification of the timing for fetching the data in the signal input-output section.

Since the first clock output section outputs the inputted second clock signal to the signal input-output section of the next stage as the first clock signal and the second clock output section outputs the first clock signal to the signal input-output section of the next stage as the second clock signal, it is possible to cancel the input-output delayed time difference between the first and second clock signals, when the continuing two signal input-output sections are regarded as one block. This allows to secure the data sampling margin and to make the transfer speed of the data signal faster.

A signal transfer apparatus, in accordance with the present invention, that is connected in a cascade manner so as to transfer a plurality of signals outputted from a signal transfer apparatus of a previous stage to a signal transfer apparatus of a next stage based on self-transfer method, characterized by further having: (a) first and second clock input sections that receive first and second clock signals, respectively, from the signal transfer apparatus of the previous stage; (b) first and second clock output sections that invert and output the first and second clock signals to the signal transfer apparatus of the next stage; (c) a data input section that receives a data signal from the previous stage in accordance with the first clock signal that has been inputted to the first clock input section; and (d) a data output section that outputs the data signal to the signal transfer apparatus of the next stage in accordance with the second clock signal that has been inputted to the second clock input section.

With the arrangement, the data signal is inputted to the data input section in accordance with the first clock signal and is outputted to the data output section in accordance with the second clock signal. This allows to output a stable data signal to the signal input-output section of the next stage even when the data signal, that has been inputted in accordance with the first clock signal, is easy to receive the affections such as the wiring capacity in the signal input-output section in the case where the data signal is transferred faster, because the data signal is outputted in accordance with the second clock signal. Thus, it is possible to guarantee the specification of the timing for fetching the data in the signal input-output section.

In addition thereto, the first and second clock output sections invert and output the first and second clock signals with respect to the respective next stages. This causes to cancel the fluctuation of the duty ratio occurred when the first and second clock signals pass through the signal transfer apparatus. This allows to compensate the duty ratio of the clock signals in the multiple cascade connections, thereby enabling that the transfer system operates at a higher frequency.

Another signal transfer apparatus in accordance with the present invention that is connected in a cascade manner so as to transfer a plurality of signals outputted from the signal transfer apparatus of a previous stage to the signal transfer apparatus of a next stage based on self-transferring, characterized by further having: (a) first and second clock input sections that receive first and second clock signals, respectively, from the signal transfer apparatus of a previous stage; (b) a data input section that receives a data signal from the signal transfer apparatus of a previous stage in accordance with the first clock signal that has been inputted to the first clock input section; (c) a data output section that outputs the data signal to the signal transfer apparatus of a next stage in accordance with the second clock signal that has been inputted to the second clock input section; (d) a first clock output section that outputs the second clock signal to the signal transfer apparatus of the next stage as the first clock signal; and (e) a second clock output section that outputs the first clock signal to the signal transfer apparatus of the next stage as the second clock signal.

With the arrangement, the data signal is inputted to the data input section in accordance with the first clock signal and is outputted to the data output section in accordance with the second clock signal. This allows to output a stable data signal to the signal transfer apparatus of the next stage even when the data signal, that has been inputted in accordance with the first clock signal, is easy to receive the affections such as the wiring capacity in the signal transfer apparatus in the case where the data signal is transferred faster, because the data signal is outputted in accordance with the second clock signal. Thus, it is possible to guarantee the specification of the timing for fetching the data in the signal transfer apparatus.

Since the first clock output section outputs the inputted second clock signal to the signal transfer apparatus of the next stage as the first clock signal and the second clock output section outputs the first clock signal to the signal transfer apparatus of the next stage as the second clock signal, it is possible to cancel the input-output delayed time difference between the first and second clock signals, when the continuing two signal transfer apparatuses are regarded as one block. This allows to secure the data sampling margin and to make the transfer speed of the data signal faster.

A display panel drive apparatus in accordance with the present invention for driving a display panel in which a plurality of pixels are provided and an electric signal is applied to each of the pixels so as to carry out a display, is provide with any one of the foregoing signal transfer system, and control logic section that receives the data signal from each signal input-output section of the signal transfer system and controls so as to output the electric signal to each pixel in the display panel in accordance with the data signal thus received.

With the arrangement, since the display panel is provided with a plurality of pixels, it is possible to appropriately transfer the data signal even when the data signal should be transferred at an extremely high speed. This allows to show the good display performance without display defect even to the display panel having many pixels.

According to the present invention, a display panel drive apparatus for driving a display panel in which a plurality of pixels are provided and an electric signal is applied to each of the pixels so as to carry out a display, is provided with the signal transfer apparatus and control logic section that receives the data signal from the signal transfer apparatus and controls so as to output the electric signal to each pixel in the display panel in accordance with the data signal thus received.

With the arrangement, since the display panel is provided with a plurality of pixels, it is possible to appropriately transfer the data signal even when the data signal should be transferred at an extremely high speed. This allows to show the good display performance without display defect even to the display panel having many pixels.

A display apparatus in accordance with the present invention is characterized by having: a display panel in which a plurality of pixels are provided and an electric signal is applied to each of the pixels so as to carry out a display; and any one of the display panel drive apparatus recited.

With the arrangement, since the display panel drive apparatus can transfer the data signal at a relatively high speed, it is possible to increase the number of the pixels of the display panel. Accordingly, it is possible to provide a display apparatus having an excellent display quality and enabling to carry out the high resolution display.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description. The present invention will become more fully understood from the detailed description given hereinbelow and the accompanying drawings which are given by way of illustration only, and thus, are not limitative of the present invention.

DESCRIPTION OF THE EMBODIMENTS

Figure 2:
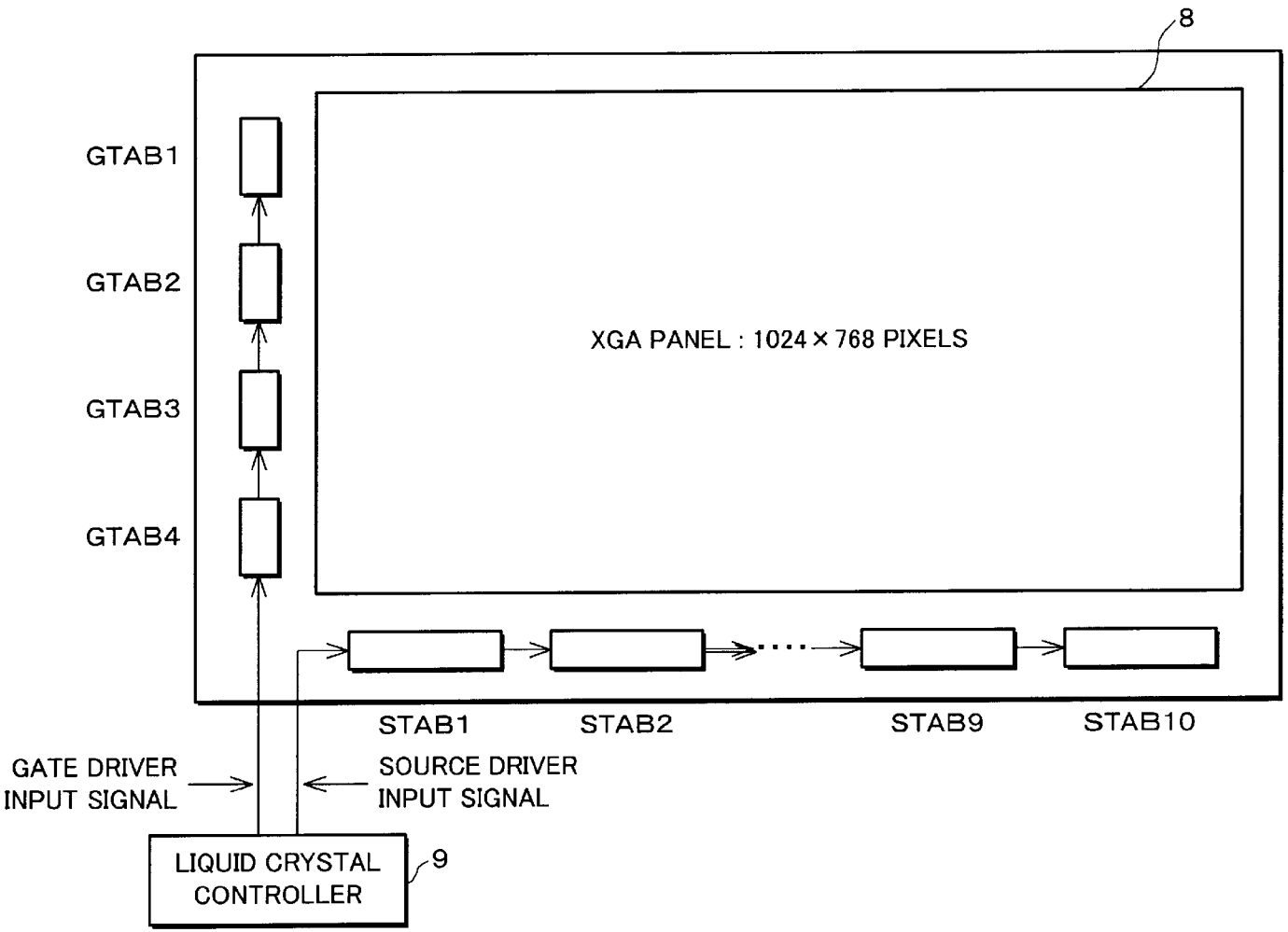
FIG. 2 is an explanatory diagram showing a schematic structure of the liquid crystal display apparatus of the present embodiment.

The following description deals with one embodiment of the present invention with reference to the drawings. FIG. 2 is an explanatory diagram showing a schematic structure of the liquid crystal display apparatus of the present embodiment. As shown in FIG. 2, the liquid crystal display apparatus is provided with a liquid crystal panel 8, a liquid crystal controller 9, source drivers STAB1 through STAB10, and a gate driver GTAB1 through GTAB4.

The liquid crystal panel 8 is a liquid crystal panel of an active matrix display type, and is provided with an active matrix substrate on which a plurality of pixel electrodes are provided in a matrix manner, an opposing substrate on which an opposing electrode is provided, and a liquid crystal layer that is provided between the active matrix substrate and the opposing substrate (all not shown).

The active matrix substrate is provided with TFTs, that are connected with the respective pixel electrodes, for selectively driving the pixel electrodes. Each gate electrode of the TFTs is connected with a gate bus line, and each source electrode of the TFTs is connected with a source bus line. The gate bus line and the source bus line are provided so as to extend orthogonal to each other around the respective pixel electrodes that are provided in a matrix manner. Upon receipt of a gate signal via the gate bus line, the TFT is driven and controlled. A data signal (a display signal) is sent to the pixel electrode via the TFT during the driving of the TFT. This allows that an electric field is generated between the pixel electrode and the opposing electrode. The electric field causes the alignment state of the liquid crystal to change so as to display the image.

Each source bus line is connected with source drivers STAB1 through STAB10. The data signal is sent to each source bus line from the respective source drivers STAB1 through STAB10. The respective gate bus lines are connected with the gate driver GTAB1 through GTAB4. The gate signal is sent to the gate bus lines from the gate driver GTAB1 through GTAB4, respectively.

Note that the liquid crystal panel 8 is assumed to be an XGA panel that is constituted by 1024×768 pixels according to the present embodiment. More specifically, the liquid crystal panel 8 is provided with 1024 source bus lines and 768 gate bus lines. However, the present invention is not limited to this structure. For example, the present invention can be adapted to a liquid crystal panel having an arbitrary number of pixels such as SXGA. It is possible to set the number of the source drivers and the number of the gate drivers according to the need.

The liquid crystal controller 9 is constituted by a PWB (Printed Wiring Board) so that a source driver input signal is sent to the source driver STAB1 while a gate driver input signal is sent to the gate driver GTAB1. The source drivers STAB1 through STAB10 and the gate driver GTAB1 through GTAB4 are provided so that the respective neighboring drivers are connected with each other. More specifically, the source driver input signal that has been sent to the source driver STAB1 is transferred to the source driver STAB2, and from STAB2 to STAB3, from STAB3 to STAB4, . . . , in this order. Similarly, the gate driver input signal that has been sent to the gate driver GTAB1 is transferred to the gate driver GTAB2, and from GTAB2 to GTAB3, from GTAB3 to GTAB4, . . . , in this order.

The source driver STAB1 through STAB10 and the gate driver GTAB1 through GTAB4 are constituted by a TAB (Tape Automated Bonding) substrate, respectively. However, the present invention is not limited to this. Instead thereof, the structure in which the source drivers and gate drivers are provided, respectively, based on the COG mounting method.

Each source driver is provided with a signal input-output section (signal transfer apparatus) for inputting and outputting of signals, a control logic section for controlling so as to output the data signal to the source bus line, and an output circuit section. As to the signal input-output section, the description will be later made. The control logic section is provided with a data sampling memory circuit, and a hold memory circuit. The output circuit section is provided with circuits such as a reference voltage generation circuit, a DA converter circuit, and an output circuit.

The hold memory circuit latches the data signal received from the signal input-output section in response to a latch signal LS upon receipt of the data corresponding to 1 horizontal period, and holds the data signal until the data corresponding to the next 1 horizontal period is received. For example, by the resistance division, the reference voltage source generation circuit generates a plurality of voltages, having respective levels to be used for the gradation display, in accordance with a reference voltage that has been inputted to the reference voltage source generation circuit. The DA converter circuit converts an RGB data signal received from the hold memory circuit to an analog signal, and sends the analog signal to the output circuit. The output circuit amplifies the data signal that has been converted to the analog signal, and sends the data signal thus amplified to each source bus line.

The following description deals in detail with the signal input-output section in the source driver. According to the present embodiment, a two phase clock method in which two basic clock signals are used. First, it is explained how the signal input-output section is basically arranged. Then, it is explained how the signal input-output section is arranged in the liquid crystal display apparatus of the present embodiment.

Figure 3:
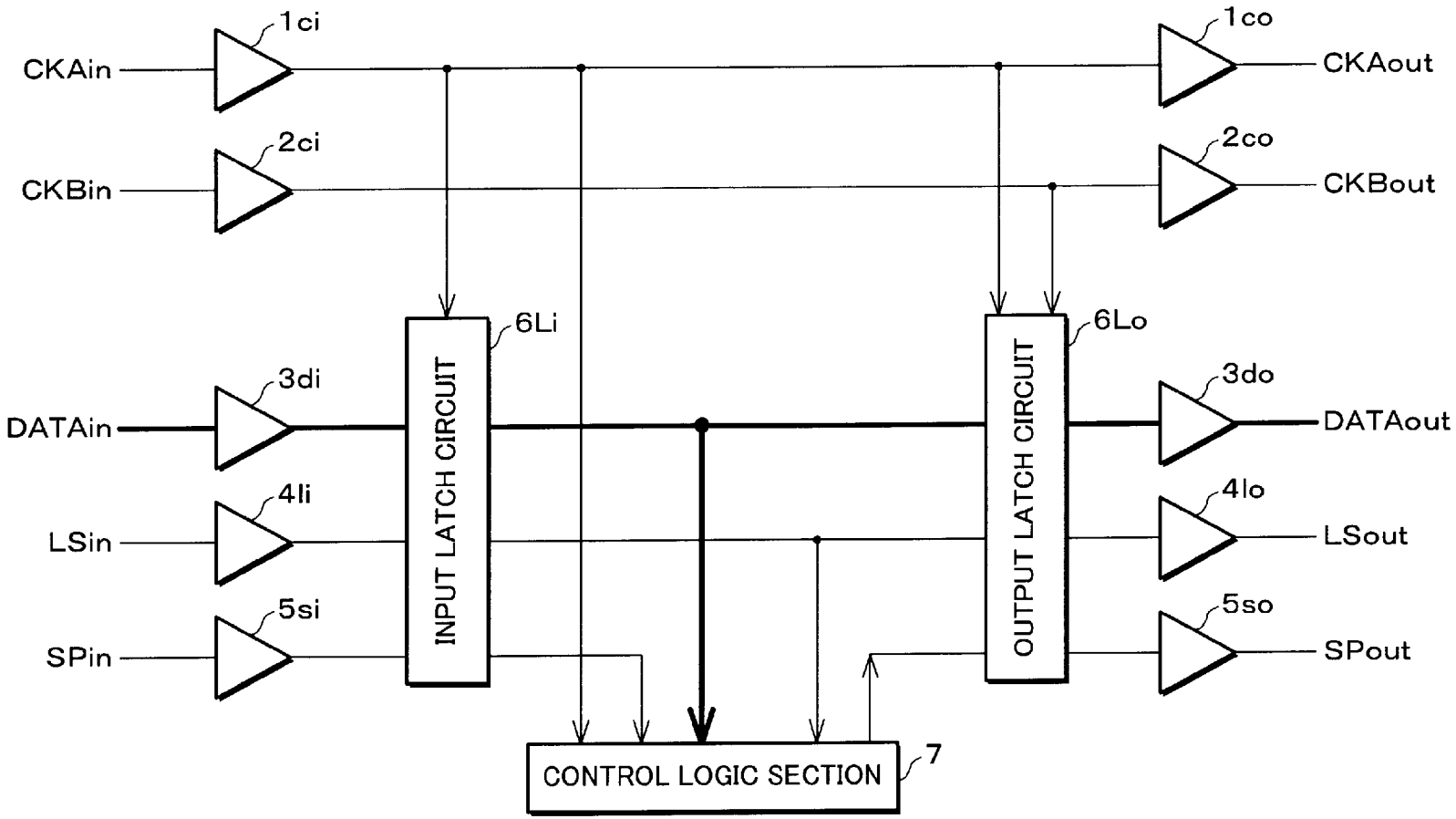
FIG. 3 is a block diagram schematically showing how a signal input-output section, in which the two phase clock method is adopted, is basically arranged.

FIG. 3 is a block diagram schematically showing how the signal input-output section, in which the two phase clock method is adopted, is basically arranged. The signal input-output section, as shown in FIG. 3, is provided with clock input terminals (the first and second clock input sections) 1*ci* and 2*ci*, clock output terminals (the first and second clock output sections) 1*co* and 2*co*, a DATA input terminal 3*di*, a DATA output terminal 3*do*, an LS input terminal 4*li*, an LS output terminal 4*lo*, an SP input terminal 5*si*, an SP output terminal 5*so*, an input latch circuit (data input section) 6Li, and an output latch circuit (data output section) 6Lo.

To the clock input terminals 1*ci* and 2*ci*, a first basic clock (the first clock signal) CKA and a second basic clock (the second clock signal) CKB are applied, respectively. The clock input terminal 1*ci* is connected with the clock output terminal 1*co*. The first basic clock CKA is outputted to the signal input-output section of the source driver of the next stage from the clock output terminal 1*co*. The clock input terminal 2*ci* is connected with the clock output terminal 2*co*. The second basic clock CKB is outputted to the signal input-output section of the source driver of the next stage from the clock output terminal 2*co*.

The clock input terminal 1*ci* is connected with the clock output terminal 1*co*. The wiring therebetween is further extended so as to be respectively connected to the input latch circuit 6Li, the control logic section 7, and the output latch circuit 6Lo. To the sections and circuits the first basic clock CKA is sent. The clock input terminal 2*ci* is connected with the clock output terminal 2*co*. The wiring therebetween is further extended so as to be connected to the output latch circuit 6Lo to which the second basic clock CKB is sent.

The data signal DATA is applied to the DATA input terminal 3*di*. The data signal DATA, according to the present embodiment, has totally 18 bits in which each 6-bit is assigned to the R, G, and B. The DATA input terminal 3*di* is connected with the DATA output terminal 3*do* via the input latch circuit 6Li and the output latch circuit 6Lo. The data signal DATA is sent to the signal input-output section of the source driver of the next stage via the DATA output terminal 3*do*.

The input latch circuit 6Li receives the data signal DATA and is connected with the output latch circuit 6Lo. The wiring therebetween is further extended so as to be connected with the control logic section 7 to which the data signal DATA is inputted.

A latch strobe signal LS is applied to the LS input terminal 4*li*. The LS input terminal 4*li* is connected with the LS output terminal 4*lo* via the input latch circuit 6Li and the output latch circuit 6Lo. The latch strobe signal LS is sent to the signal input-output section of the source driver of the next stage from the LS output terminal 4*lo*.

The input latch circuit 6Li receives the latch strobe signal LS and is connected with the output latch circuit 6Lo. The wiring therebetween is further extended so as to be connected with the control logic section 7 to which The latch strobe signal LS is inputted.

The start pulse signal SP is applied to the SP input terminal 5*si*. The SP input terminal 5*si* is connected with the SP output terminal 5*so* via the input latch circuit 6Li, the control logic section 7, and the output latch circuit 6Lo. The start pulse signal SP is sent to the signal input-output section of the source driver of the next stage from the SP output terminal 5*so*.

Figure 23:
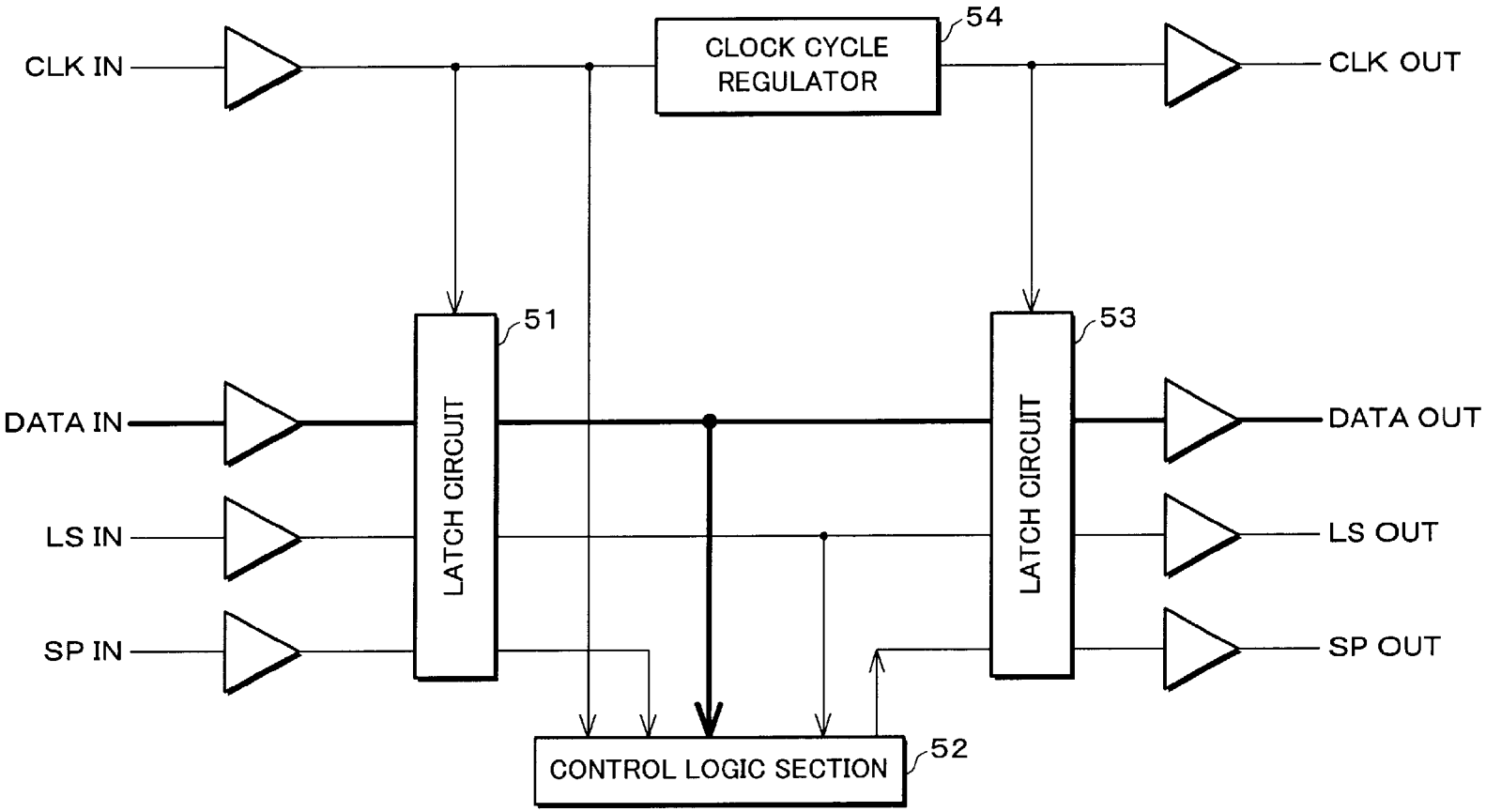
FIG. 23 is a block diagram showing a schematic structure of the input-output sections with respect to a single source driver in a conventional self-transfer method.

As described above, the difference between the arrangement shown in FIG. 23 that has been described in the conventional art and the arrangement shown in FIG. 3 resides in that the two kinds of basic clock signals, i.e. the first and second basic clocks CKA and CKB are applied and the clock cycle regulator 54 is not provided in FIG. 3.

The signal input-output section of the two phase clock method operates as follows. First, in the respective edges, i.e., the rising and falling edges of the first basic clock CKA, the data sampling is carried out by the input latch circuit 6Li which carries out the serial-parallel conversion so as to transfer the data to the control logic section 7 via the 36-bit data bus. The 36-bit data bus signal is also transferred to the output latch circuit 6Lo in which the parallel-serial conversion is carried out to the 36-bit data bus signal in accordance with the first basic clock CKA and the second basic clock CKB so as to be converted to 18-bit data bus signal. Then, the 18-bit data bus signal is transferred to the source driver of the next stage together with the first and second basic clocks CKA and CKB, the latch strobe signal LS, and the start pulse signal SP.

Thus, according to the signal input-output section of the two phase clock method, 1 channel of the data signal is fetched by the input latch circuit 6Li in synchronization with the rising and the falling edges of the first basic clock CKA, respectively, and divided into 2 channels. The frequency of the first basic clock CKA can be half of that of the data signal, accordingly. More specifically, as described above, in the case where the liquid crystal panel 8 is XGA, the frequency of the first basic clock CKA is only 32.5 MHz. The signal input-output section is advantageous in the foregoing problems of the data sampling margin and the EMI, compared with the arrangement in which the data is transferred in response to the basic clock signal of 65 MHz.

In addition thereto, during the outputting, the data is fetched in synchronization with the respective rising and falling of the second basic clock CKB that is delayed by ¼ period from the first basic clock CKA so as to be returned to 1 channel again. This allows to stably output the data signal to the source driver of the next stage because the sampling is carried out in accordance with the second basic clock CKB even when the data signal that has been sampled in response to the first basic clock CKA is easy to be affected by the wiring capacity or other factors in the source driver. This ensures to guarantee the specification of the timing for fetching the data in the source driver of each stage.

Figure 4:
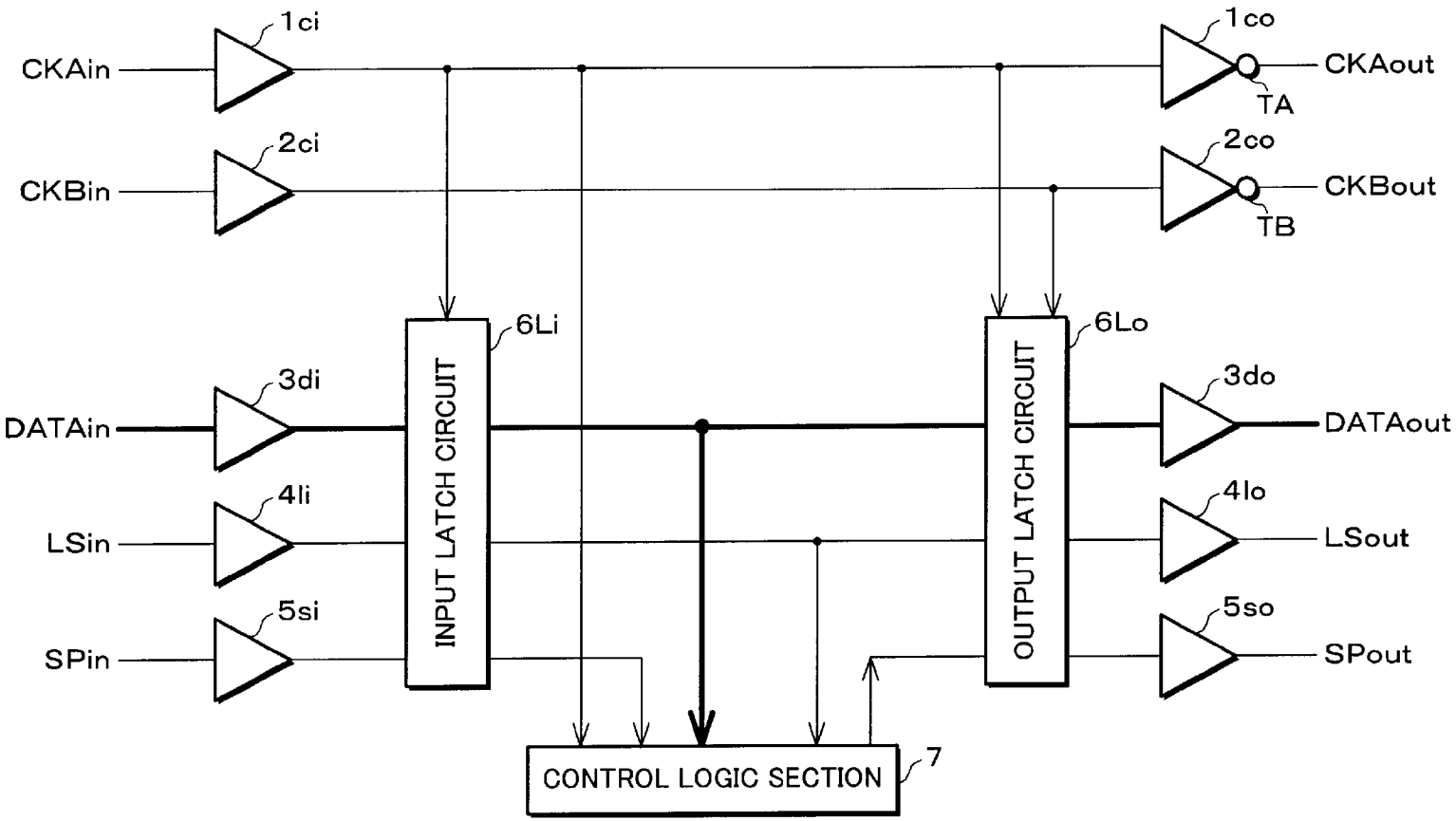
FIG. 4 is a block diagram schematically showing how a signal input-output section, in which the two phase clock method with a clock signal inversion transfer method is adopted, is basically arranged.

However, since the clock cycle regulator is not provided according to the arrangement of FIG. 3, the problem arises that the duty ratio of the first and second basic clocks CKA and CKB may not be maintained in the process of the transferrings of the multiple cascade connections. In view of the problems, according to the present embodiment, the signal input-output section is arranged to adopt the clock signal inversion transfer system (method) shown in FIG. 4 so as to compensate the duty ratio of the basic clock signals in the multiple cascade connections. According to the arrangement, as shown in FIG. 4, inverter circuits TA and TB are respectively provided before the clock output terminals 1*co* and 2*co* in which the first and second basic clocks CKA and CKB are inverted prior to being sent to the source driver of the next stage. The other arrangement is same as that of FIG. 3, the description thereof is omitted here, accordingly. With the arrangement, the fluctuation of the duty ratio occurred when the basic clock signals pass through each source driver is canceled by the neighboring source drivers, thereby enabling to compensate the duty ratio of the basic clock signals in the multiple cascade connections.

As has been described above, according to the signal input-output section of two phase clock method, it is possible to suppress the problems of the data sampling margin and the EMI. Since the provision of the clock cycle regulator is no longer required, it is also possible to realize the multiple cascade connections without increasing the chip size of the source driver.

However, as the further bulky and highly precise liquid crystal module is required from now on, the problem arises even in the foregoing two phase clock method. More specifically, the bulky and highly precise liquid crystal module causes to increase the number of the source drivers to be required. This causes to increase the wiring capacity and wiring resistance of the transferring routes of the first and second basic clocks CKA and CKB in the source drivers that are connected with each other in a cascade manner. This results in that the difference between the wiring impedances in the transferring routes of the respective first and second basic clocks CKA and CKB becomes large. Accordingly, as the number of the cascade connection stages becomes great, the time difference between the input-output in the first basic clock CKA and the time difference between the input-output in the first basic clock CKB become more different with each other in each source driver, thereby causing that the appropriate data sampling can not be carried out.

The following description deals in detail with the time difference between the input-output in the first basic clock CKA and the time difference between the input-output in the first basic clock CKB, respectively. According to the arrangement shown in FIG. 4, the first and second basic clocks CKA and CKB are sent to each source driver via the clock input terminals 1*ci* and 2*ci*, and are inverted by the respective inverter circuits TA and TB so as to be buffer-outputted to the source driver of the next stage.

Delayed times τA and τB occur between the clock output terminal 1*co* and the clock input terminal 1*ci* and between the clock output terminal 2*co* and the clock input terminal 2*ci*, respectively. Theoretically, τA is equal to τB. In actual, however, the relation of τA and τB changes depending on how the wiring is made in the TAB substrate that constitutes the source driver or other reasons. More specifically, when it can be designed so that the wiring impedance of the first basic clock CKA is substantially equal to that of the second basic clock CKB, the relation of τA=τB can be satisfied. In actual, however, it is very difficult to make the wiring impedances be identical with each other because of the reasons such as the limit of the wiring layout in the source driver and the unevenness of the characteristics of the semiconductors in the source driver due to the power source, the ambient temperature, and the unevennesses of the processes.

Due to the foregoing reasons, in the actual arrangement, τA≠τB is satisfied. Here, the definition is made as follows. More specifically, the input-output delayed time difference between the first and second basic clocks CKA and CKB is defined as τ=|τA−τB |, the delayed time difference τ including the cases of τA>τB and τA<τB.

Figure 5:
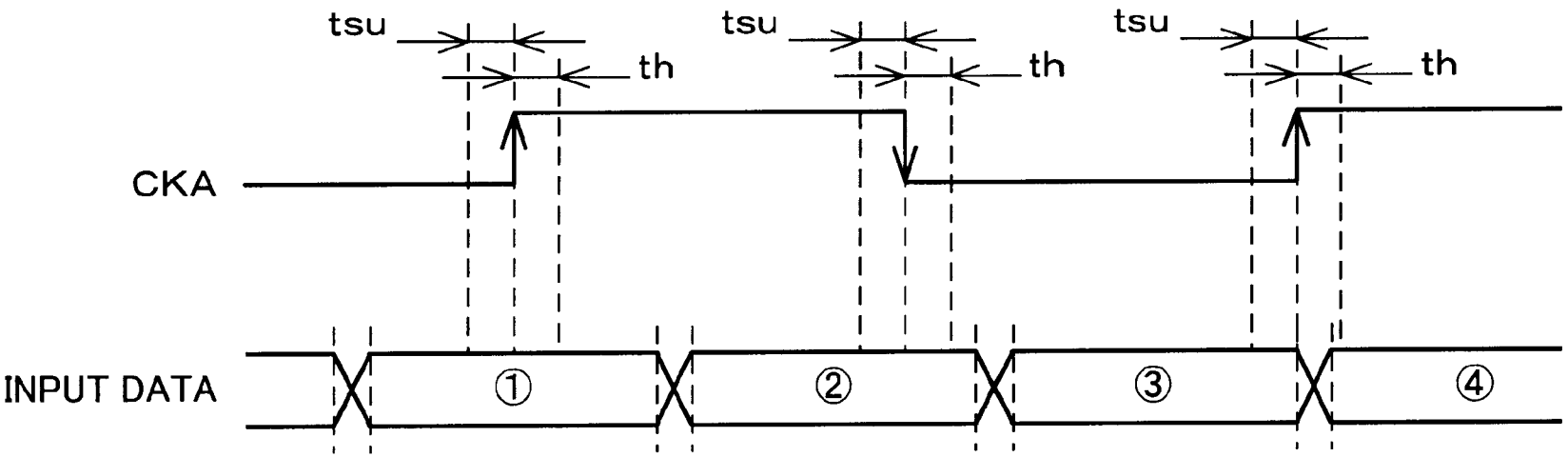
FIG. 5 is an explanatory diagram showing an example of a timing chart of the first basic clock and an input data.

The following description deals with how the delayed time difference τ affects the data sampling margin. In the data transfer system adopting the two phase clock method, each source driver carries out the sampling of the input data in synchronization with the rising and falling edges of the first basic clock CKA. When making the sampling of the data, the data setup time tsu and the data hold time th are required for the rising and falling edges of the clock signal, respectively. FIG. 5 is an example of the timing chart of the first basic clock CKA and the input data. According to the example shown in FIG. 5, since the input data changes from the data indicated as ③ to the data indicated as ④ within the period of the data setup time tsu and the data hold time th for the rising and falling edges of the first basic clock CKA, the sampling during the period can not be appropriately carried out.

Figure 6:
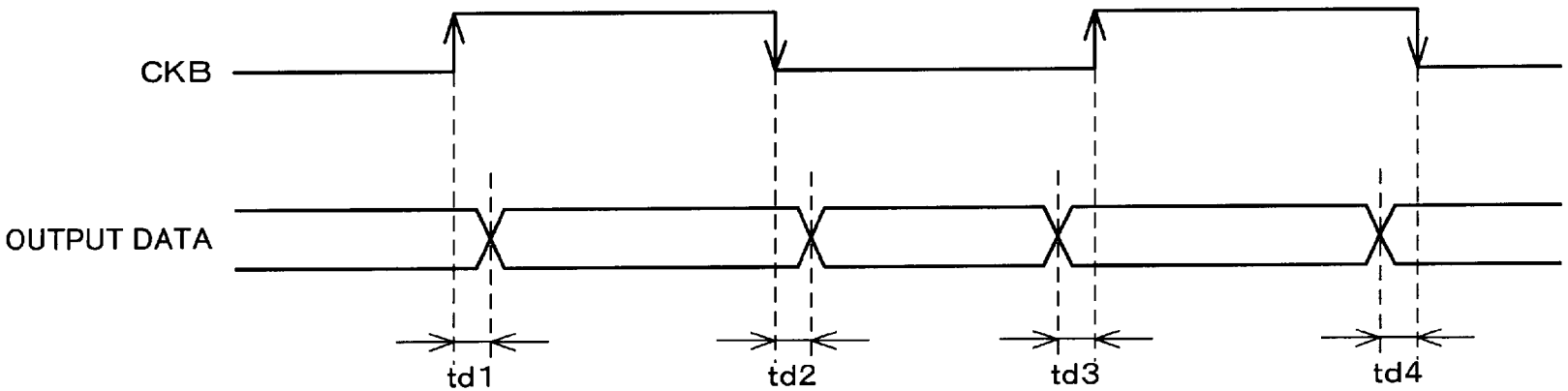
FIG. 6 is an explanatory diagram showing an example of a timing chart of an output data and the second basic clock signal.

Further, according to the data transfer system adopting the two phase method, each source driver selects the output data in synchronization with the rising and falling edges of the second basic clock CKB. FIG. 6 shows an example of the timing chart of the output data and the second basic clock CKB. As shown in FIG. 6, the time differences between the timing of the rising and falling edges of the second basic clock CKB and the changing points of the output data are indicated as td1, td2, . . . , tdi, . . . , respectively. And, it is assumed that the maximum value is indicated as td (=|tdi|max). Note that the time differences between the timing of the rising and falling edges of the second basic clock CKB and the changing points of the output data are caused by the problems of (a) the wiring delay of the second basic clock CKB and the output data and (b) the gate delay in the circuit for conducting the parallel-serial conversion with respect to the data in response to the second basic clock CKB.

Figure 7:
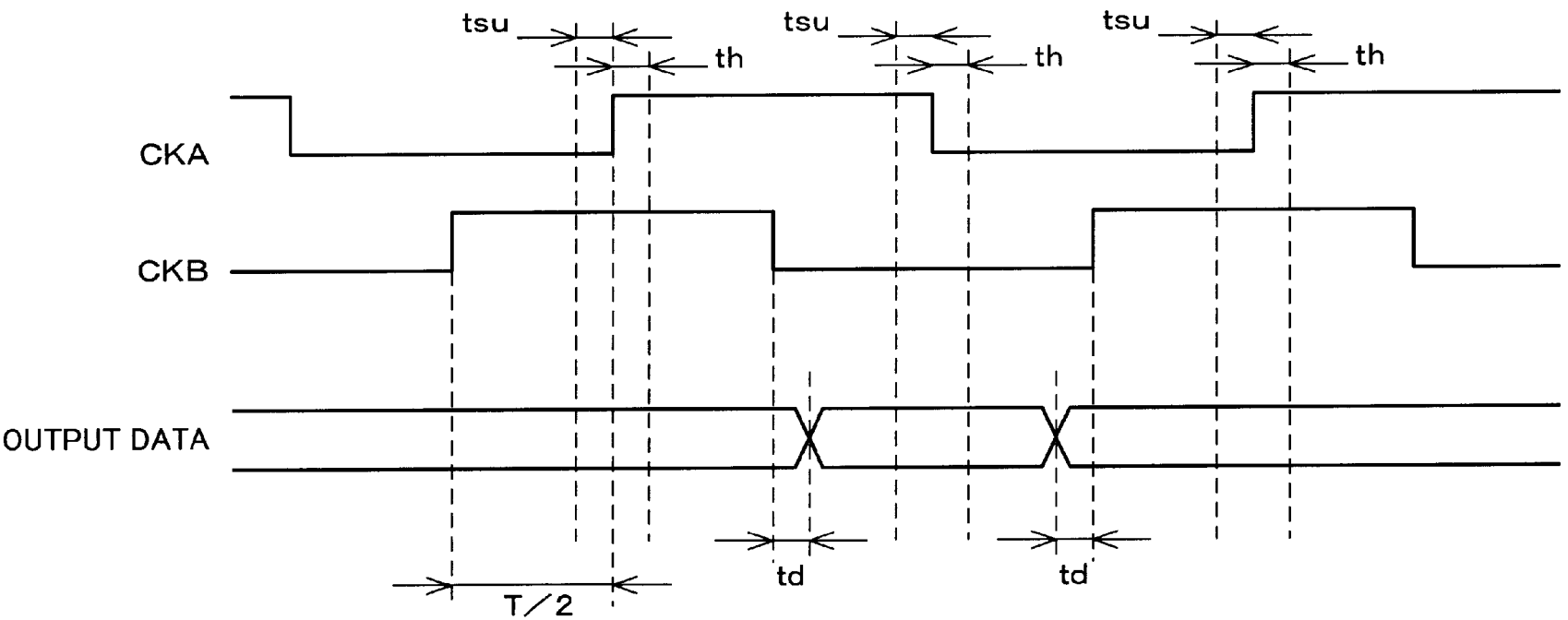
FIG. 7 is an explanatory diagram showing a timing chart of the first basic clock signal, the second basic clock signal, and the output data.

The timing chart of the first and second basic clocks CKA and CKB, and the output data is shown in FIG. 7. According to FIG. 7, in order to (a) make the sampling of the input data in synchronization with the respective rising and falling edges of the first basic clock CKA and (b) select the output data in synchronization with the respective rising and falling edges of the second basic clock CKB, the following inequality should be satisfied.

$$td+\max(tsu,th)<T/2 \quad (1)$$

Figure 8:
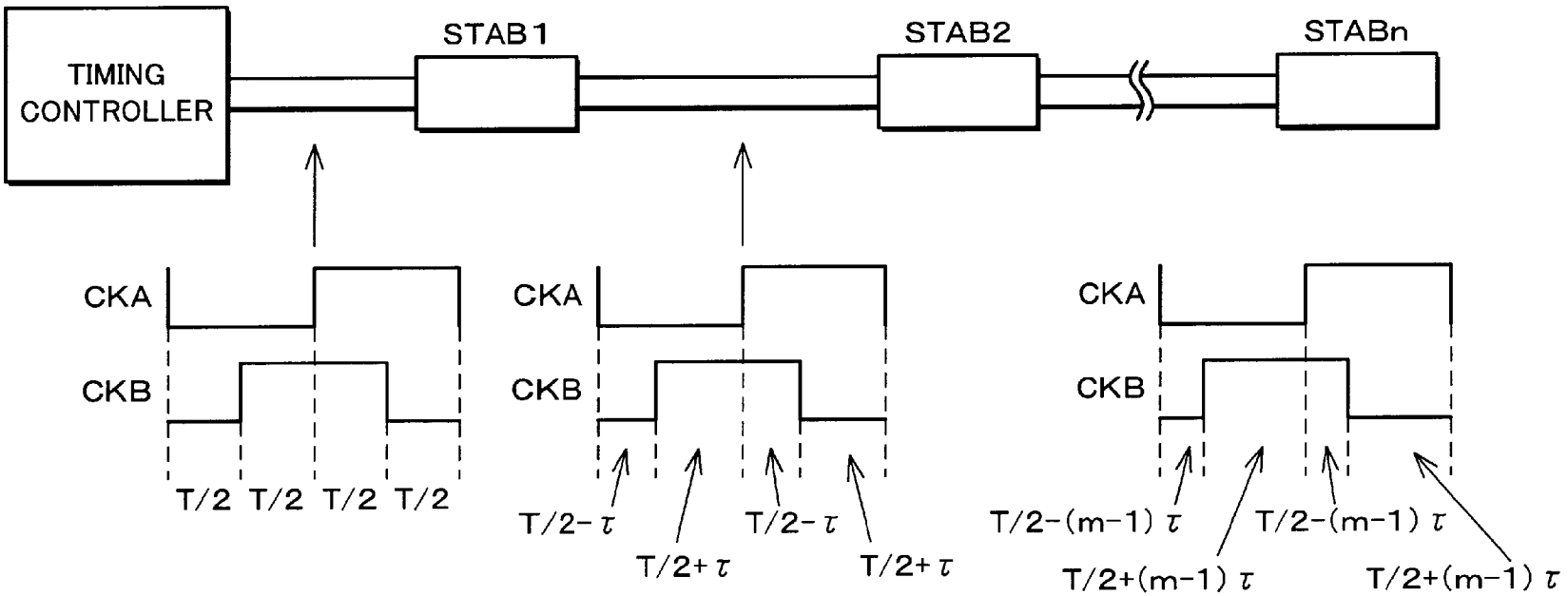
FIG. 8 is an explanatory diagram showing the deviation of the first and second basic clock signals when the first and second basic clock signals are transferred from a timing controller to respective source drivers that are connected in cascade with each other.

In actual, the input-output delayed time difference τ exists between the first and second basic clocks CKA and CKB. The input-output delayed time difference τ causes to change the inequality (1). FIG. 8 is an explanatory diagram showing the deviation of the first and second basic clocks CKA and CKB when the first and second basic clocks CKA and CKB are transferred from the timing controller to the respective source drivers STAB1 through STABn that are connected in cascade with each other. Just after the outputting from the timing controller, as shown in FIG. 8, the deviation of the first and second basic clocks CKA and CKB is exactly equal to T/2. In contrast, when outputted from the source driver STAB1, the deviation of the first and second basic clocks CKA and CKB becomes greater, i.e., (T/2+τ). The respective deviations are added by each source driver. And, when outputted from the source driver STAB(n−1), the deviation of the first and second basic clocks CKA and CKB becomes (T/2+(n−1)τ).

Accordingly, in the source driver STABn of the final stage, when taking the input-output delayed time difference τ into consideration, the foregoing inequality (1) is modified as the following inequality (2).

$$(n-1)\tau+td+\max(tsu,\ th)<T/2 \quad (2)$$

More specifically, in the multiple cascade connections, when input-output delayed time difference τ exists between the first and second basic clocks CKA and CKB, in order to (a) make the sampling of the input data in synchronization with the respective rising and falling edges of the first basic clock CKA and (b) select the output data in synchronization with the respective rising and falling edges of the second basic clock CKB, the above inequality (2) should be satisfied.

Figure 1:
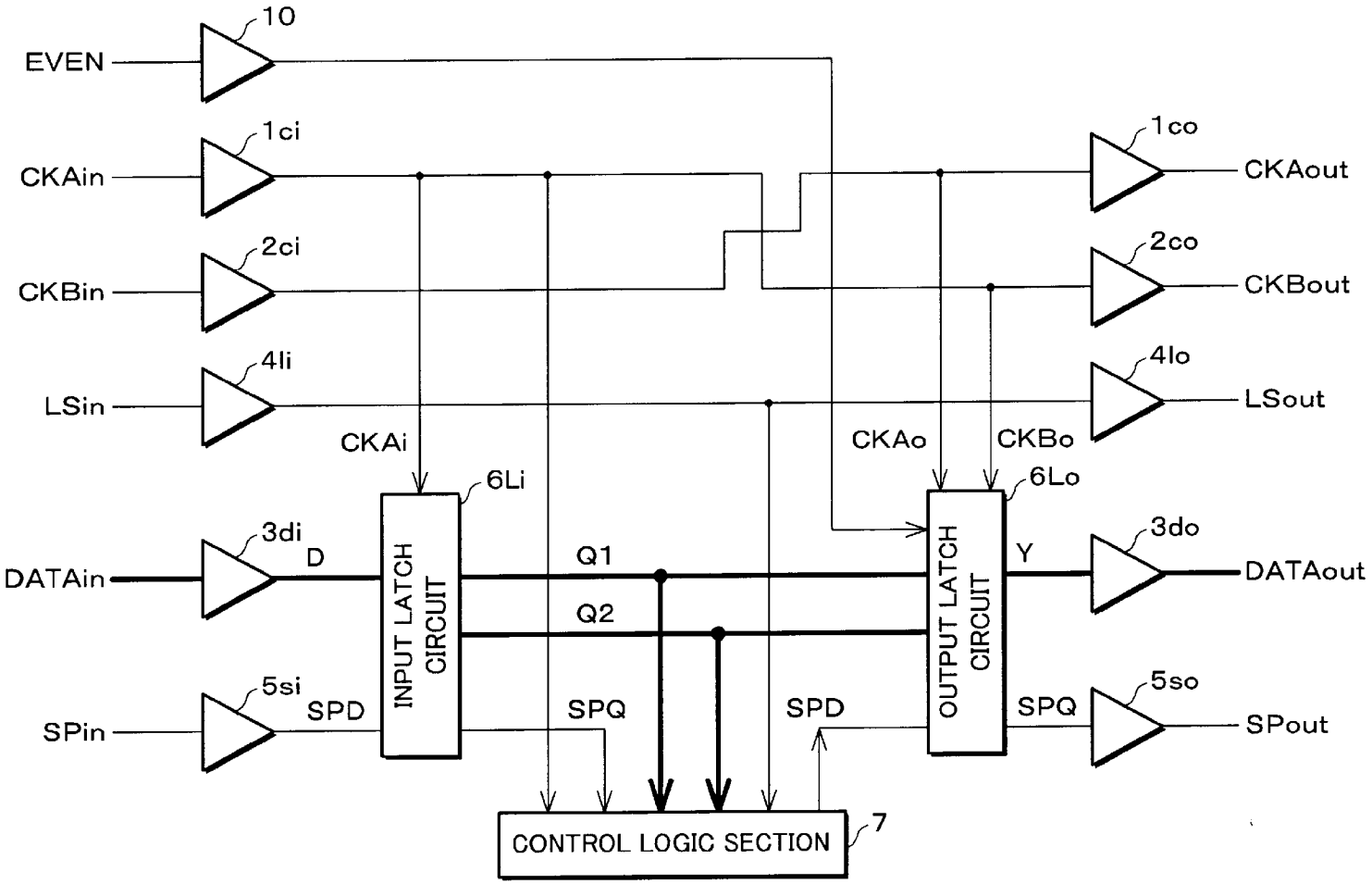
FIG. 1 is a block diagram showing a schematic structure of a signal input-output section in a source driver that is included by a liquid crystal display apparatus of an embodiment in accordance with the present invention.

Note that in the present embodiment, in order to cancel τ in the inequality (2), the signal input-output section of the source driver may be arranged as shown in FIG. 1. As shown in FIG. 1, the signal input-output section is different from the structure shown in FIG. 3 in that (a) the clock input terminal 1*ci* is connected with the clock output terminal 2*co* while the clock input terminal 2*ci* is connected with the clock output terminal 1*co*, and (b) an EVEN terminal (discrimination means) via which an EVEN signal is applied is connected with the output latch circuit 6Lo. The other structures are substantially the same as those of the structure shown in FIG. 3.

Figure 10B:
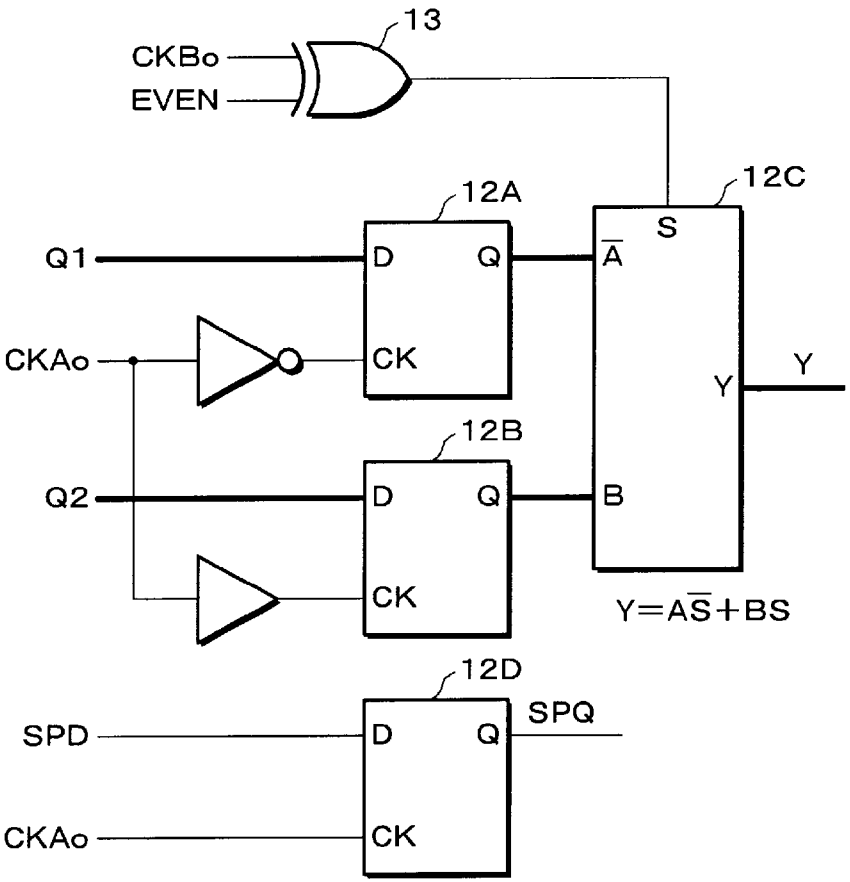
FIGS. 10(*a*) and 10(*b*) are circuit diagrams respectively showing schematic structures of an input latch circuit and an output latch circuit.
Figure 10A:
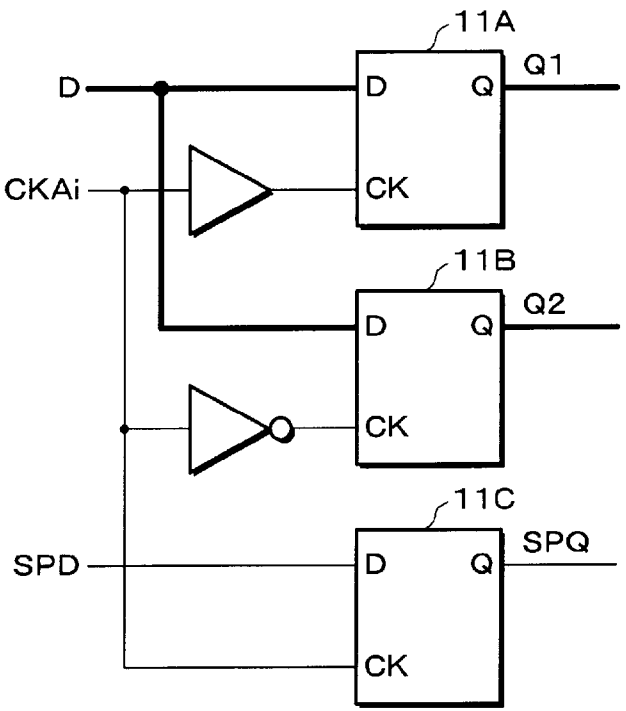

FIGS. 10(*a*) and 10(*b*) are circuit diagrams respectively showing the schematic structure of the input latch circuit 6Li and the output latch circuit 6Lo. The input latch circuit 6Li is provided with flip flops 11A, 11B, and 11C, as shown in FIG. 10(*a*).

An 18-bit data signal D that has been supplied via the DATA input terminal 3*di* is sent to D-terminals of the respective flip flops 11A and 11B. The first basic clock CKAi that has been supplied via the input terminal 1*ci* is sent to a CK-terminal of the flip flop 11A, and is sent to a CK-terminal of the flip flop 11B via an inverter. The flip flops 11A and 11B output the data of the D-terminals via respective Q-terminals in synchronization with the rising of the clock signals that have been supplied to the CK-clock terminals. This allows that the flip flop 11A outputs data signal Q1 via the Q-terminal in synchronization with the rising of the first basic clock signal CKAi, and the flip flop 11B outputs data signal Q2 via the Q-terminal in synchronization with the falling of the first basic clock signal CKAi. The data signals Q1 and Q2 are transferred to the control logic circuit 7 and the output latch circuit 6Lo. In other words, the flip flops 11A and 11B carry out the serial-parallel conversion with respect to the data signal that has been serially supplied, and transfers the resultant of the conversion to the control logic circuit 7.

The start pulse signal SP is applied to a D-terminal of the flip flop 11C, and the first basic clock signal CKAi is applied to a CK-terminal of the flip flop 11C. The flip flop 11C outputs the start pulse signal SPQ via a Q-terminal in synchronization with the falling of the first basic clock signal CKAi. The output signal SPQ is outputted to the control logic circuit 7 as the start pulse signal.

The output latch circuit 6Lo is provided with flip flops 12A, 12B, 12C, and 12D, and an exclusive OR gate 13. In the flip flop 12A, a D-terminal receives the data signal Q1 that has been supplied from the input latch circuit 6Li, a CK-terminal receives, via an inverter, the first basic clock CKAo that is outputted via the clock terminal 1*co*. In the flip flop 12B, a D-terminal receives the data signal Q2 that has been supplied from the input latch circuit 6Li, a CK-terminal receives the first basic clock CKAo. This allows that the flip flop 12A outputs the data signal Q1 via the Q-terminal in synchronization with the rising of the first basic clock signal CKAo and the flip flop 12B outputs data signal Q2 via the Q-terminal in synchronization with the falling of the first basic clock signal CKAo. The data signals Q1 and Q2 are sent to an inverted input terminal A and input terminal B of the flip flop 12C, respectively. Note that the first basic clock signal CKAo corresponds to the signal that has been applied to the clock input terminal 2*ci* as the second basic clock CKB.

In the flip flop 12C, an S-terminal (set terminal) receives the output signal of the exclusive OR gate 13. The exclusive OR gate 13 receives the second basic clock CKBo and the EVEN signal, and conducts the exclusive OR operation thereto so as to output the resultant of the operation to the S-terminal of the flip flop 12C. The flip flop 12C outputs the resultant of the logical operation of Y=ASt+BS via an output terminal Y, where "St" indicates the resultant of the inversion of "S". According to the setting of the EVEN signal, the data signals Q1 and Q2 are outputted via the terminal Y in synchronization with the rising and falling of the second basic clock CKBo. In other words, the flip flops 12C carries out the parallel-serial conversion with respect to the data signals Q1 and Q2 that have been paralelly supplied and outputs the resultant of the conversion via the output terminal Y.

In the flip flop 12D, a D-terminal receives a start pulse signal SPD, and a CK-terminal receives the first basic clock CKAo. The flip flop 12D outputs a start pulse signal SPQ via its Q-terminal in synchronization with the falling of the first basic clock signal CKAo. The start pulse signal SPQ is sent to the source driver of the next stage.

According to the structures shown in FIG. 1, FIG. 10(*a*), and FIG. 10(*b*), the inputted data signal is converted to the signals of the 2-channel in the input latch circuit 6Li, i.e., the data signals Q1 and Q2, and sent to the control logic circuit 7 in which the data signals Q1 and Q2 (2-channel) are returned (synthesized) to a signal of 1-channel again. This allows that the parallel data can be applied to the control logic circuit 7. The parallel processing allows to ensure the required processing speed even when the processing speed of the data processing section of the control logic section 7 is relatively slow.

By the way, in the case where the data processing section of the control logic section 7 can carry out the processing at a high speed, it may not be necessary to carry out the serial-parallel conversion in the input latch circuit 6Li and the parallel-serial conversion in the output latch circuit 6Lo. Namely, in this case, the inputted data of 1-channel is, as it is, sent to the control logic section 7.

Figure 11:
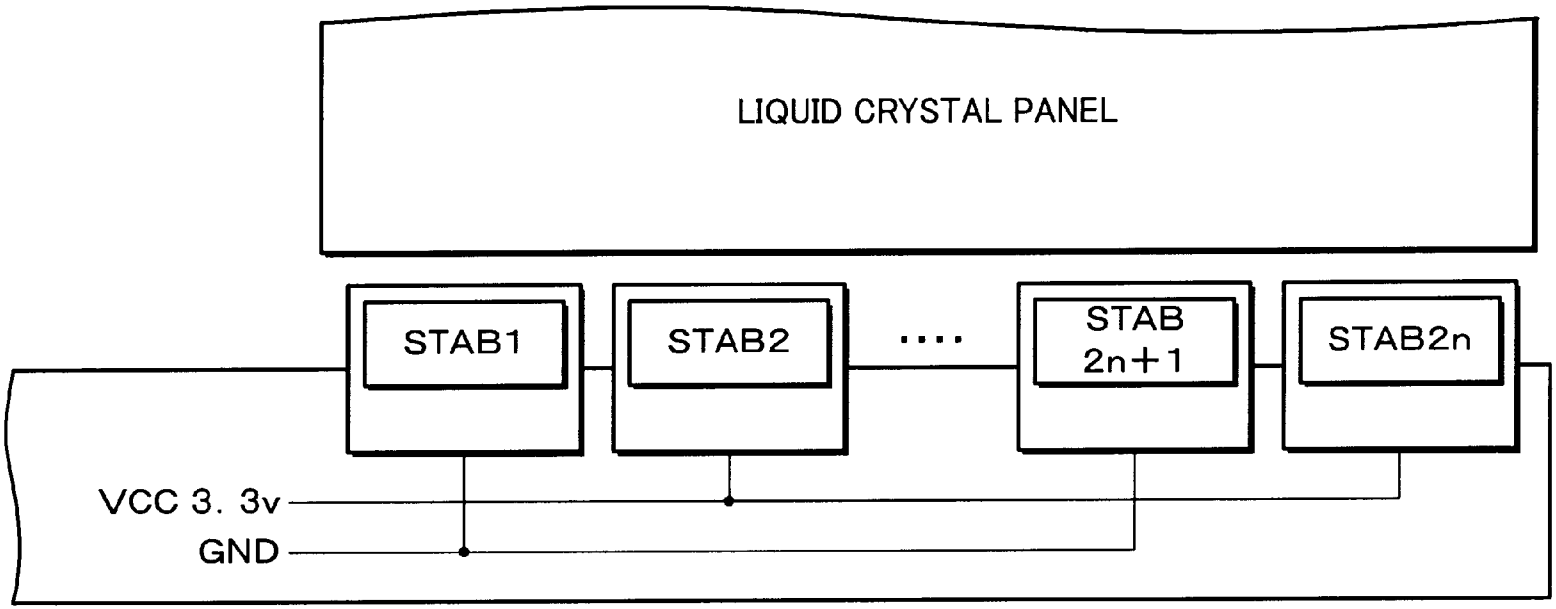
FIG. 11 is an explanatory diagram showing an example of the structure in which an EVEN signal is inputted to each source driver.

The EVEN signal discriminates whether the source driver is of an odd-numbered stage or of an even-numbered stage. For example, as shown in FIG. 11, the EVEN signal can be realized by the arrangement wherein a voltage of "L" level, i.e., GND level is supplied to each source driver of an odd-numbered stage while a voltage of "H" level, i.e., 3.3V (VCC) is supplied to each source driver of an even-numbered stage.

Figure 12:
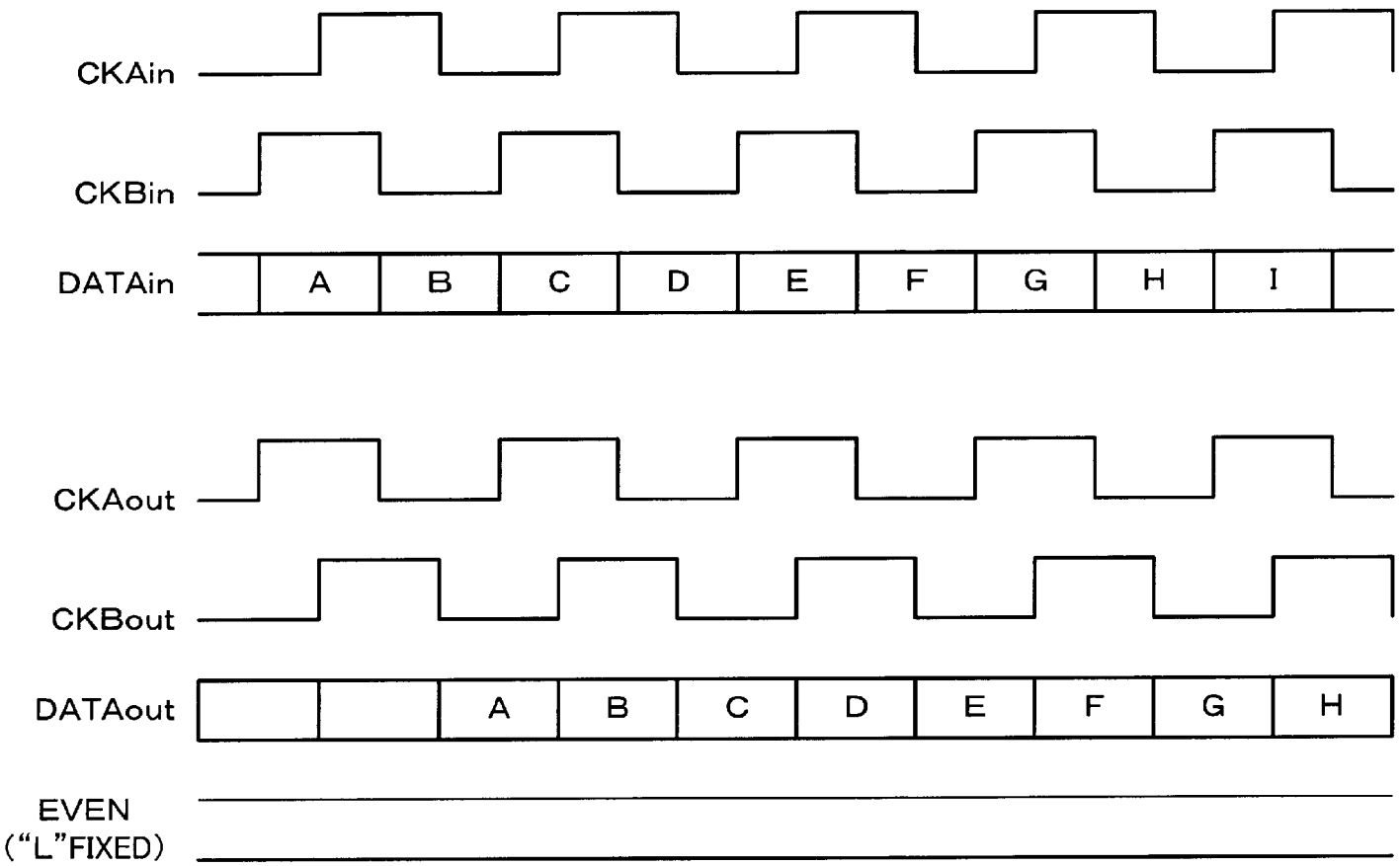
FIG. 12 is a timing chart of input-output of the clock signals and the data signal in the source driver of an odd-numbered stage.

FIG. 12 is a timing chart of input-output of the clock signals and the data signal in the source driver of an odd-numbered stage. As shown in FIG. 12, as to the data sampling of the data signal, the sampling of the DATAin is carried out in synchronization with the rising and falling of the first basic clock CKAin. The first basic clock CKAout changes in accordance with the second basic clock CKBin, while the second basic clock CKBout changes in accordance with the first basic clock CKAin. The DATAout is outputted in synchronization with the rising and falling of the second basic clock CKBout. Note that the EVEN signal is fixed to a voltage of "L" level.

Figure 13:
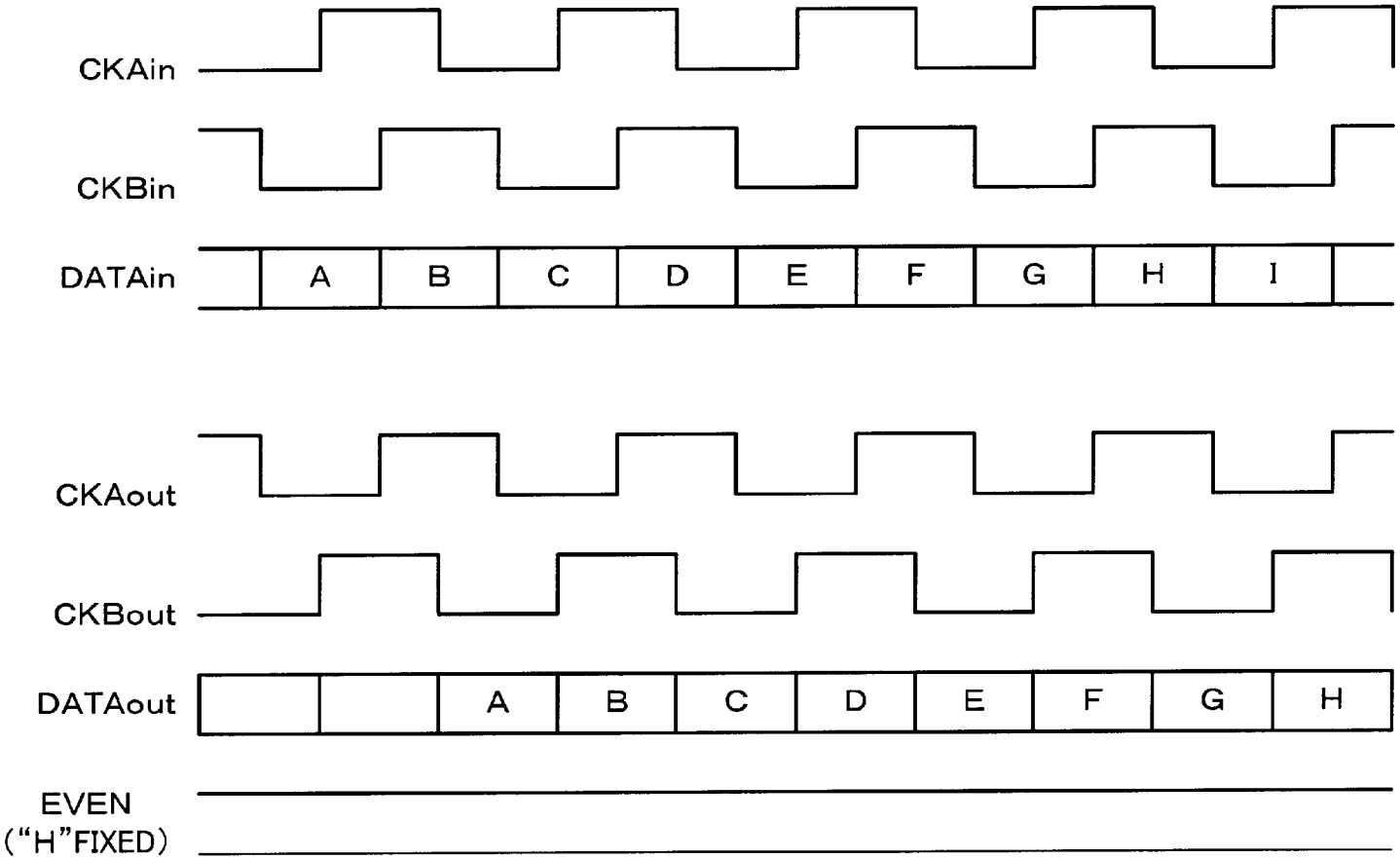
FIG. 13 is a timing chart of input-output of the clock signals and the data signal in the source driver of an even-numbered stage.

FIG. 13 is a timing chart of input-output of the clock signals and the data signal in the source driver of an even-numbered stage. As shown in FIG. 13, as to the data sampling of the data signal, the sampling of the DATAin is carried out in synchronization with the rising and falling of the first basic clock CKAin. The first basic clock CKAout changes in accordance with the second basic clock CKBin, while the second basic clock CKBout changes in accordance with the first basic clock CKAin. The DATAout is outputted in synchronization with the rising and falling of the second basic clock CKBout. Note that the EVEN signal is fixed to a voltage of "H" level.

As has been described above, according to the structure of the signal input-output section shown in FIG. 1, the clock input terminal 1*ci* is connected with the clock output terminal 2*co* while the clock input terminal 2*ci* is connected with the clock output terminal 1*co*. This allows that the input-output delayed time difference $\tau$ between the first and second basic clocks CKA and CKB is canceled. The following description deals in detail with the cancellation.

Figure 9:
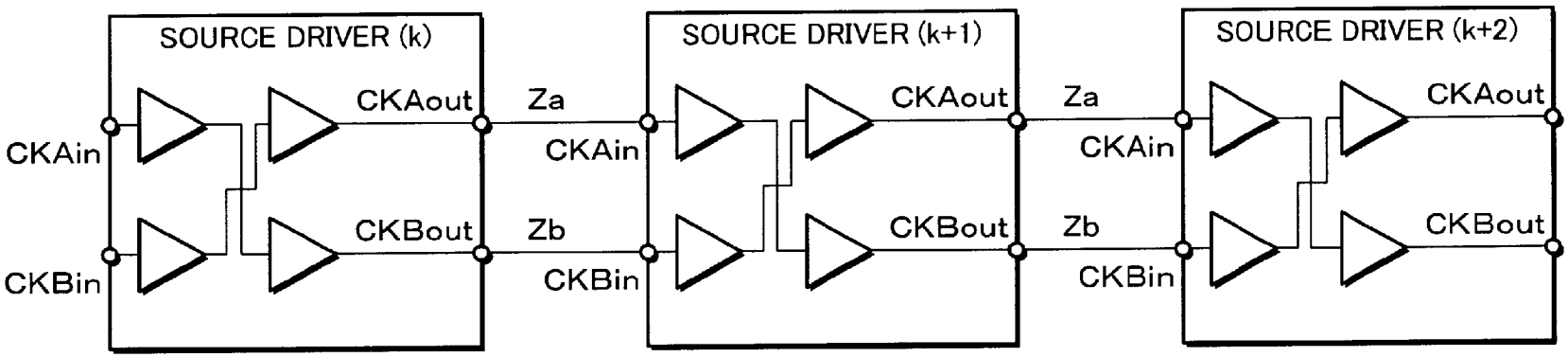
FIG. 9 is an explanatory diagram showing only the signal input-output sections of the respective source drivers of the kth, the (k+1)th, and the (k+2)th.

FIG. 9 is an explanatory diagram showing the signal input-output sections of the respective source drivers of the kth, the (k+1)th, and the (k+2)th. Here, it is assumed that the source drivers are referred to as source driver (k), source driver (k+1), and source driver (k+2), respectively.

It is also assumed that tab is indicative of the input-output delayed time difference in the source driver between the CKAin (the first basic clock CKA during the inputting) and the CKBout (the second basic clock CKB during the outputting) and tba is indicative of the input-output delayed time difference in the source driver between the CKBin (the second basic clock CKB during the inputting) and the CKAout (the first basic clock CKA during the outputting). It is further assumed in the wiring connecting the continuing (neighboring) source drivers that ta is indicative of the signal delay time due to the wiring impedance Za of the CKAout and CKAin while tb is indicative of the signal delay time due to the wiring impedance Zb of the CKBout and CKBin.

Note that the respective wiring impedances Za and Zb are formed by the connection resistor due to the ACF (Anisotropic Conductive Film) that is the connection part connecting the TAB substrate with the wiring between the TAB substrates, the TCP (Tape Carrier Package) capacitor, and the resistor, capacitor and inductor of the wiring between the TAB substrates.

The clock signal delay time (2τa) generated from the input terminal CKAin in the source driver (k) to the input terminal CKAin in the source driver (k+1) is indicated as the following equation (3).

$$2\tau a = tab + tb + tba + ta \quad (3)$$

The clock signal delay time (2τb) generated from the input terminal CKBin in the source driver (k) to the input terminal CKBin in the source driver (k+1) is indicated as the following equation (4).

$$2\tau b = tba + ta + tab + tb \quad (4)$$

The equations (3) and (4) allows to satisfy τa=τb. More specifically, according to the data transfer carried out by the source driver having the signal input-output section shown in FIG. 1, when regarding two source drivers as a basic unit, it is theoretically possible to make zero the input-output delayed time difference τ between the first and second basic clocks CKA and CKB. Since it is thus possible to make zero the term τ in the equation (2), it is possible to further alleviate the requirement of the equation (2). This ensures to fully respond even to the case in which the liquid crystal panel having a higher resolution is adopted.

Figure 14:
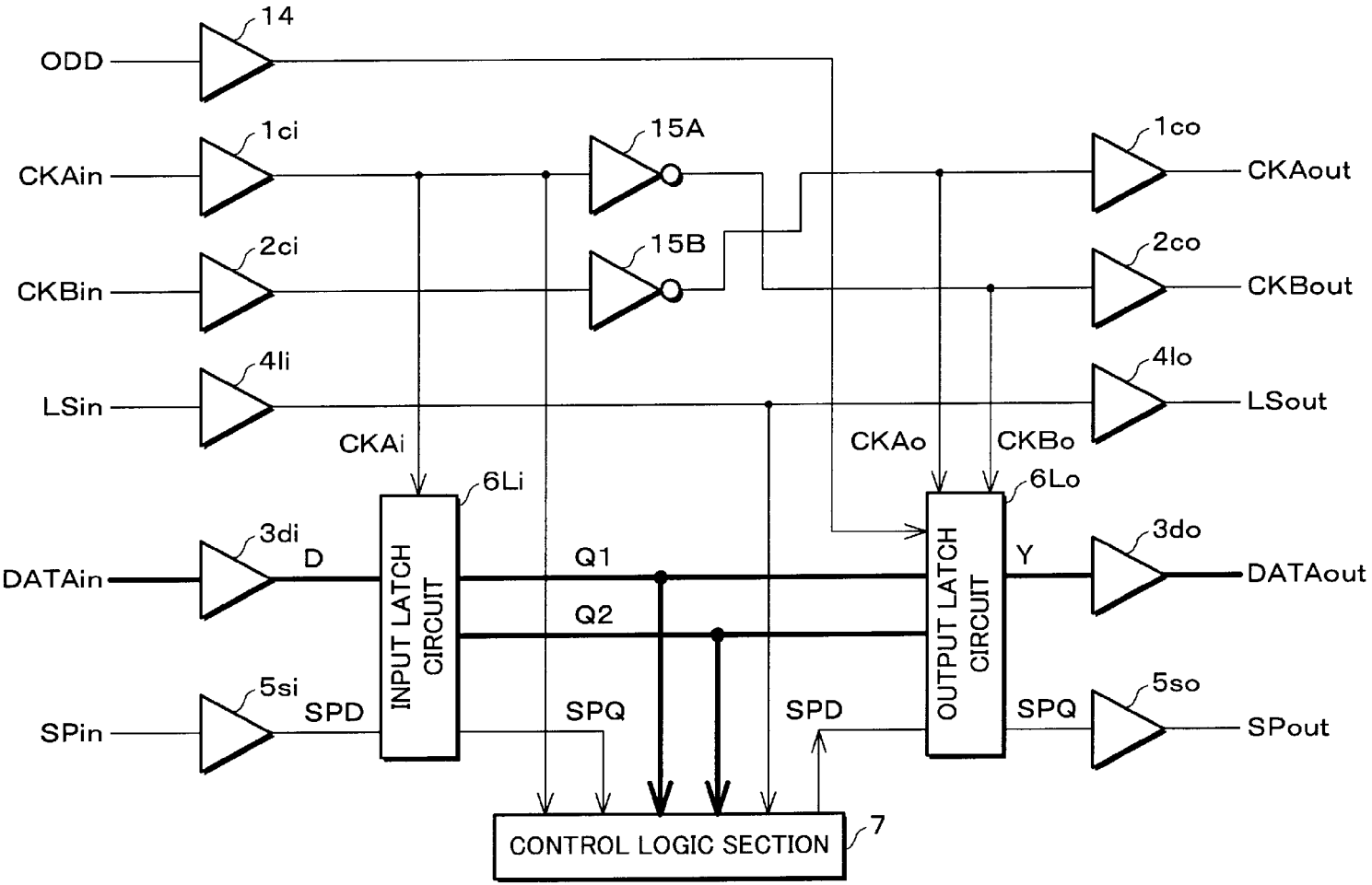
FIG. 14 is a block diagram showing a schematic structure of a signal input-output section in another source driver that is different from the structure shown in FIG. 1.

Instead of the arrangement shown in FIG. 1, the signal input-output section may have the arrangement shown in FIG. 14. The signal input-output section shown in FIG. 14 is different from the structure shown in FIG. 1 in that (a) an inverter circuit 15A is provided between the clock input terminal 1*ci* and the output terminal 2*co*, (b) an inverter 15B is provided between the clock the input terminal 2*ci* and the clock output terminal 1*co*, and (c) an ODD terminal (discrimination means) via which an ODD signal is applied is connected with the output latch circuit 6Lo. The other structure is substantially the same as those of the structure shown in FIG. 1.

The inverter circuits 15A and 15B invert a signal that has been inputted thereto. Since the inverter circuits 15A and 15B are provided between the clock input terminal 1*ci* and the output terminal 2*co* and between the clock the input terminal 2*ci* and the clock output terminal 1*co*, respectively, the fluctuation of the duty ratio occurred when the basic clock signals pass through each source driver is canceled by the neighboring source drivers. This allows to compensate the duty ratio of the basic clock signals in the multiple cascade connections so that the operation at higher frequencies can be possible.

The ODD signal discriminates whether the source driver is of an odd-numbered stage or of an even-numbered stage. The ODD signal can be realized by the arrangement similar to that shown in FIG. 11. In the case of the ODD signal, a voltage of "L" level, i.e., GND level is supplied to each source driver of an even-numbered stage while a voltage of "H" level, i.e., 3.3V (VCC) is supplied to each source driver of an odd-numbered stage.

Note that the input latch circuit 6Li and the output latch circuit 6Lo shown in FIG. 14 can be realized by the substantially the same structure as that shown in FIGS. 10(*a*) and 10(*b*). Accordingly, the description thereof is omitted here. It should be noted that the ODD signal is applied to the output latch circuit 6Lo shown in FIG. 14, instead of the EVEN signal of FIG. 10(*b*).

Figure 15:
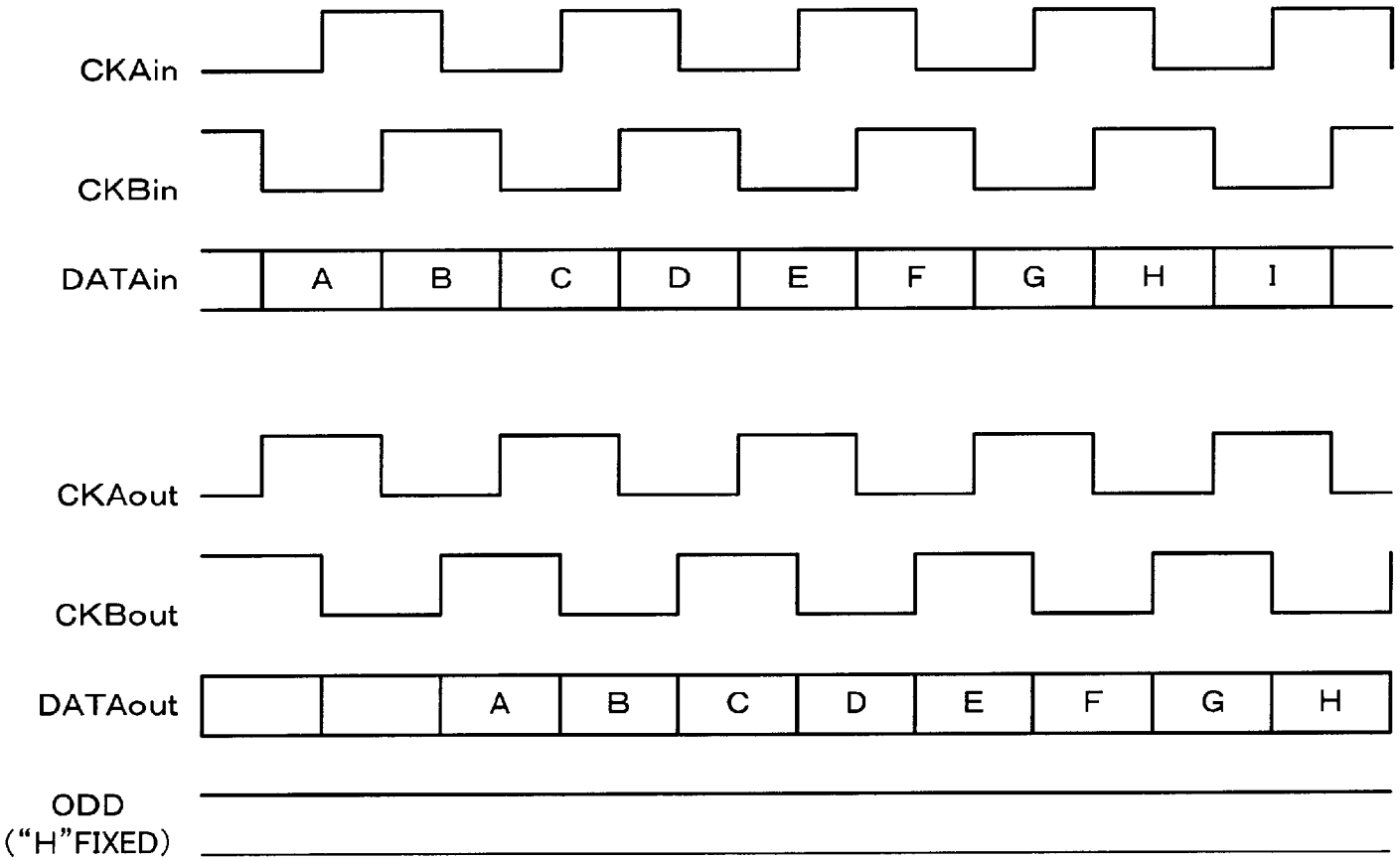
FIG. 15 is a timing chart of input-output of the clock signals and the data signal in the source driver, shown in FIG. 14, of an odd-numbered stage.

FIG. 15 is a timing chart of input-output of the clock signals and the data signal in the source driver of an odd-numbered stage. As shown in FIG. 15, as to the data sampling of the data signal, the sampling of the DATAin is carried out in synchronization with the rising and falling of the first basic clock CKAin. The first basic clock CKAout changes in accordance with the second basic clock CKBin, while the second basic clock CKBout changes in accordance with the first basic clock CKAin. The DATAout is outputted in synchronization with the rising and falling of the second basic clock CKBout. Note that the ODD signal is fixed to a voltage of "H" level.

Figure 16:
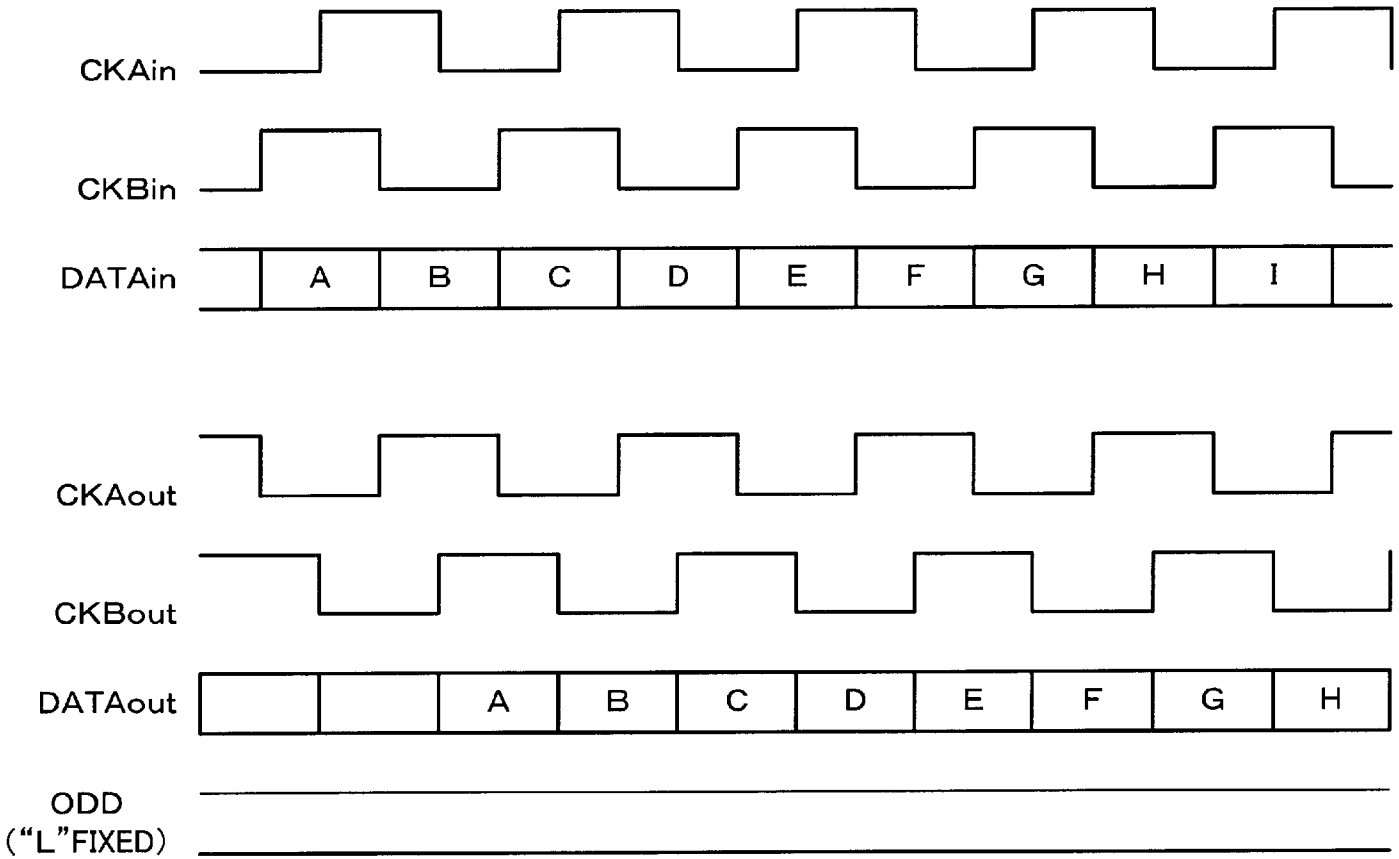
FIG. 16 is a timing chart of input-output of the clock signals and the data signal in the source driver, shown in FIG. 14, of an even-numbered stage.
Figure 17:
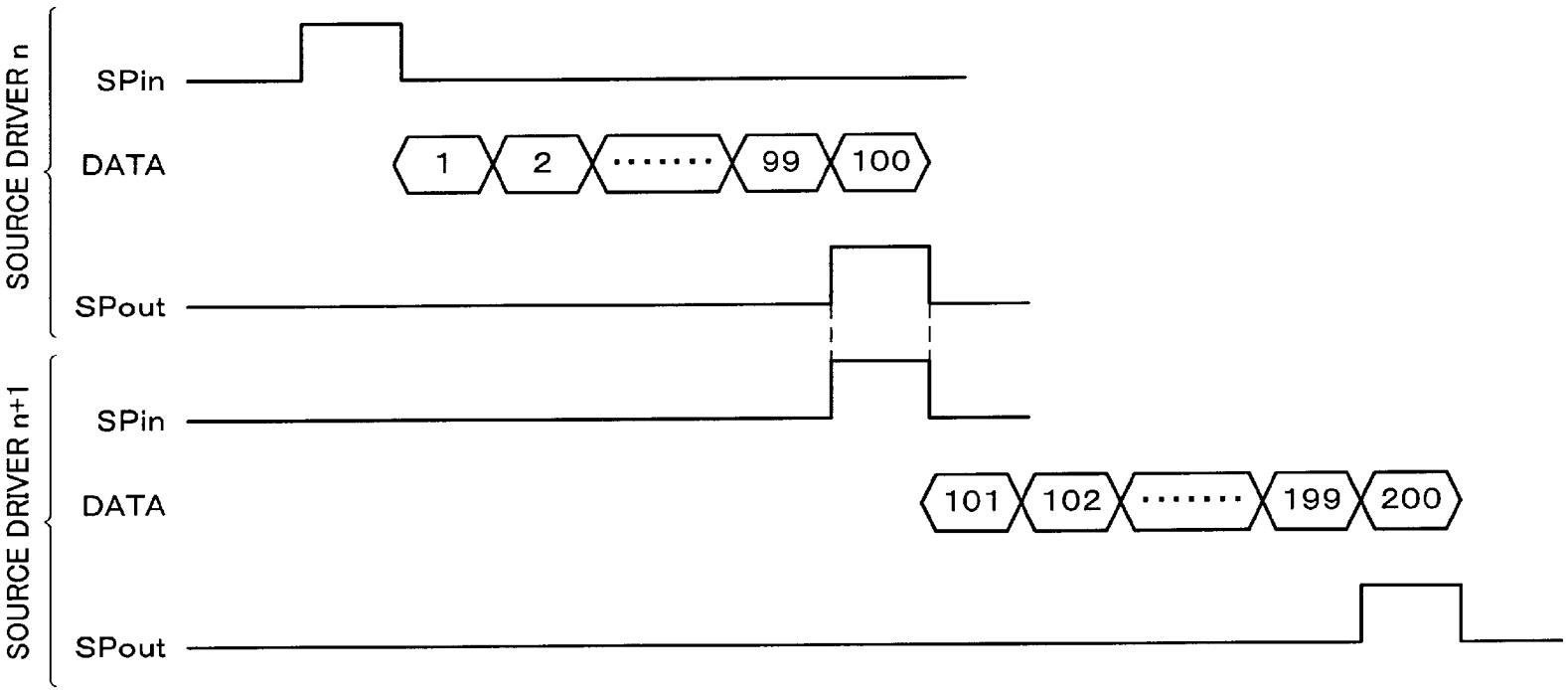
FIG. 17 is a time chart showing the respective signals in the nth source driver n and the (n+1)th source driver n+1 in a conventional arrangement.
Figure 18:
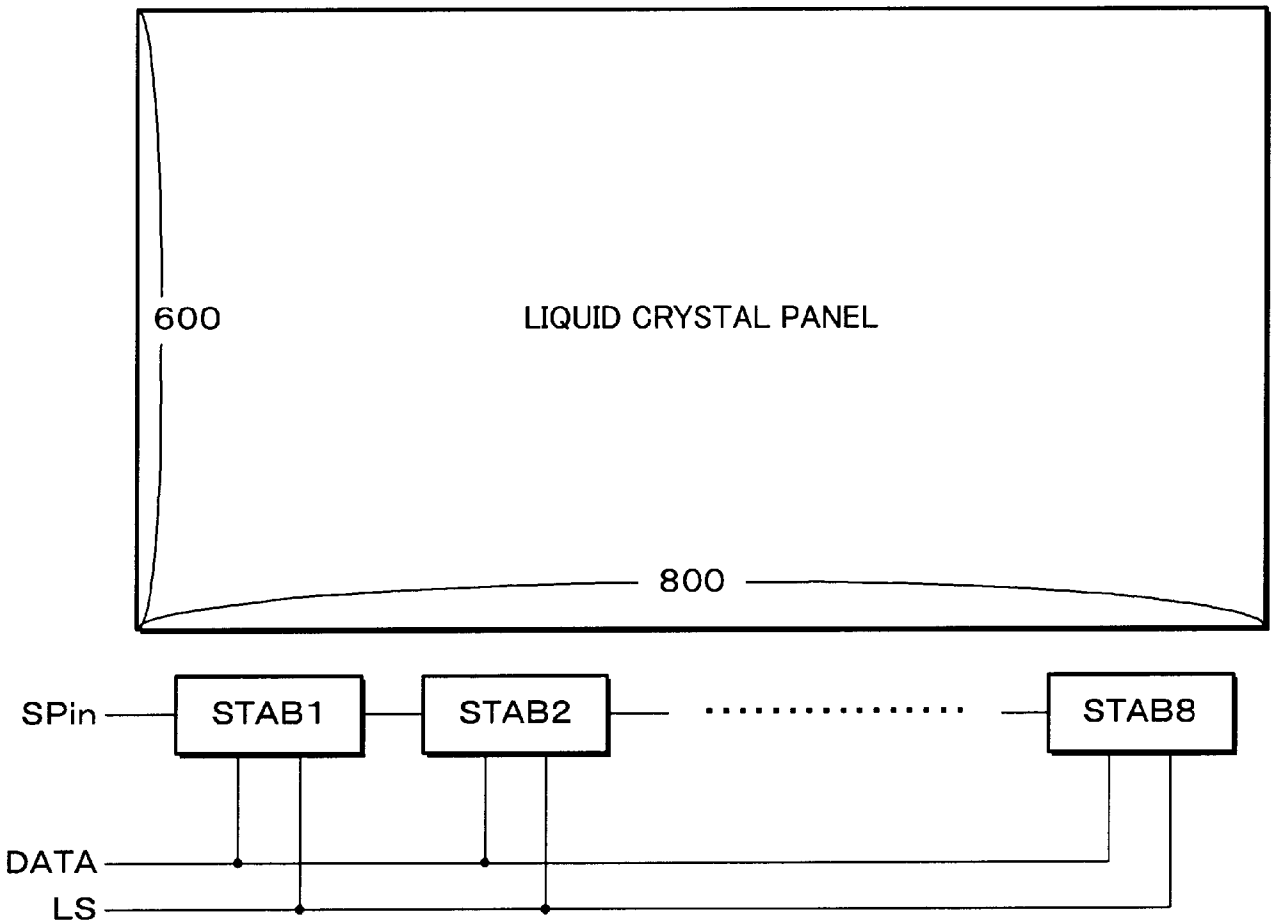
FIG. 18 is an explanatory diagram showing a schematic connecting state of the source drivers in a conventional liquid crystal panel.
Figure 19:
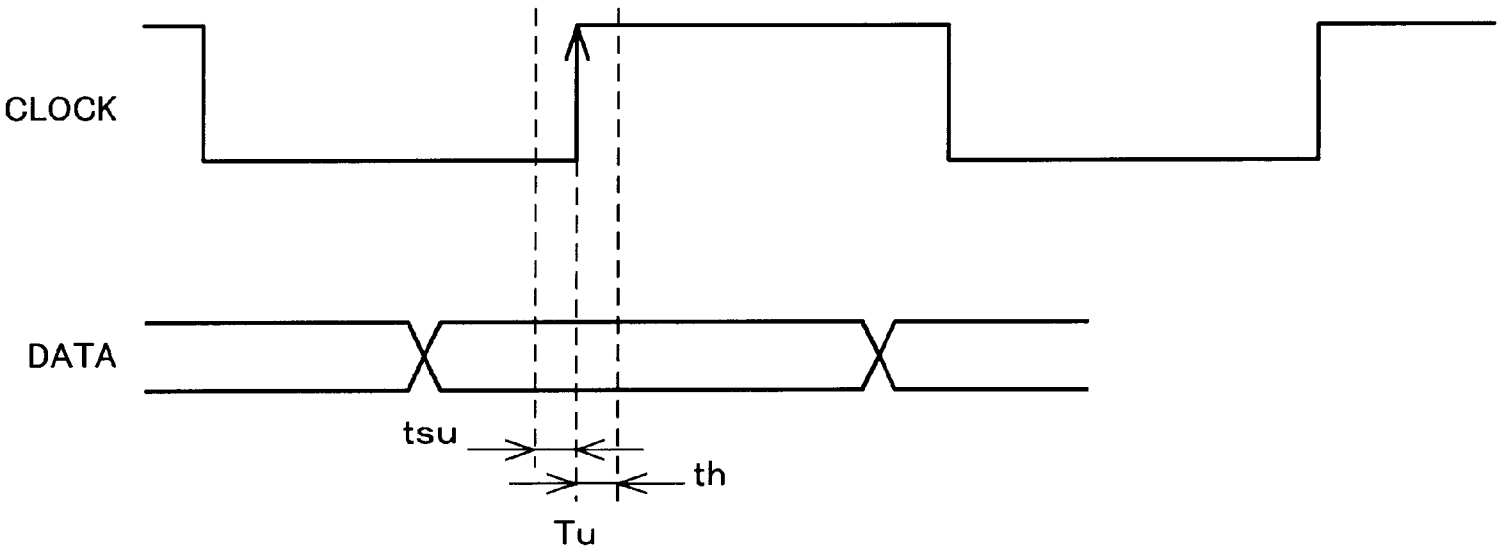
FIG. 19 is a timing chart of the clock signal and the data signal in a conventional arrangement.
Figure 20A:
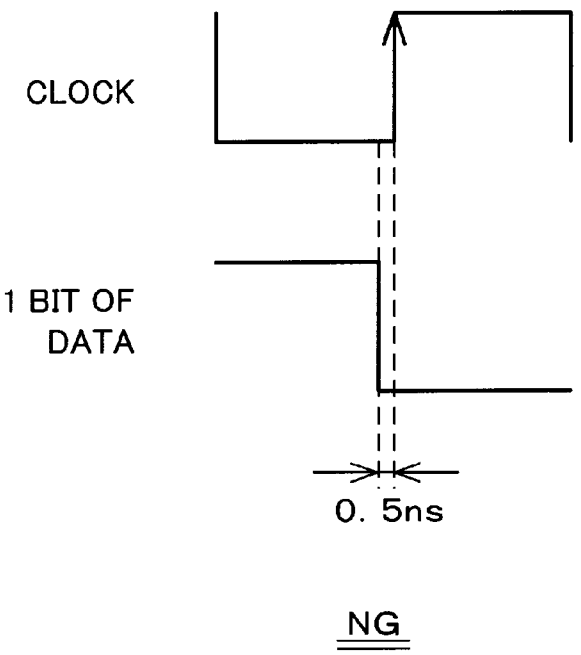
FIGS. 20(*a*) and 20(*b*) are explanatory diagrams showing examples of time charts showing the relation between the clock signal and 1 bit of the data.
Figure 20B:
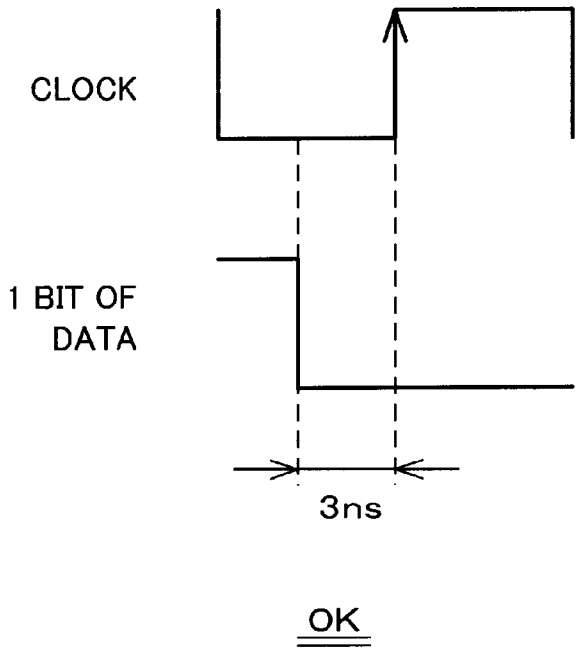
Figure 21:
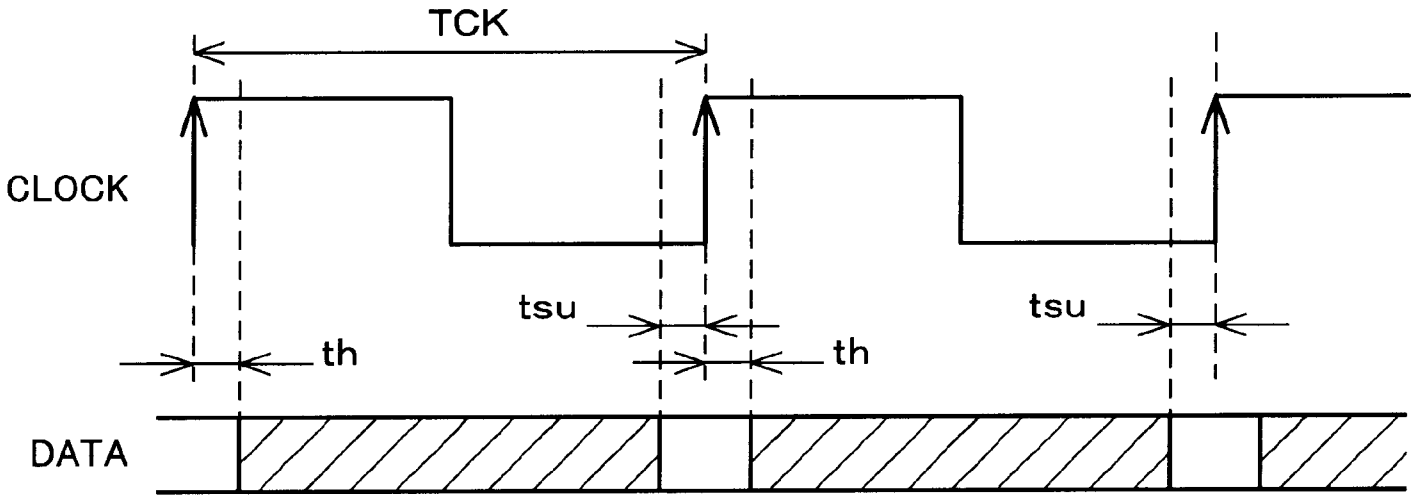
FIG. 21 is an explanatory diagram showing a data sampling margin.
Figure 22:
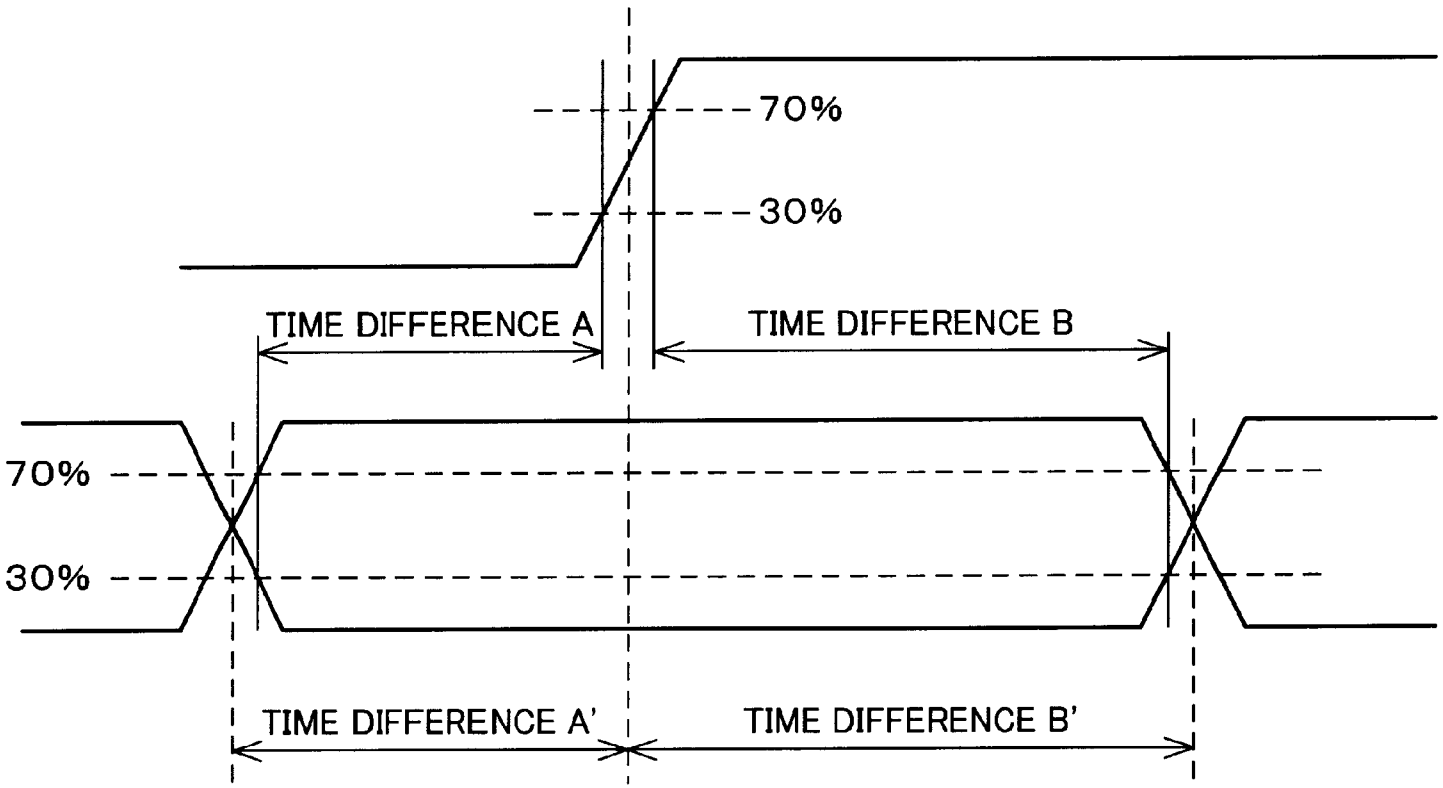
FIG. 22 is an explanatory diagram showing the relation of the time differences in which the time required for the rising and falling is considered and the time differences in which the time required for the rising and falling is not considered.

FIG. 16 is a timing chart of input-output of the clock signals and the data signal in the source driver of an even-numbered stage. As shown in FIG. 16, as to the data sampling of the data signal, the sampling of the DATAin is carried out in synchronization with the rising and falling of the first basic clock CKAin. The first basic clock CKAout changes in accordance with the second basic clock CKBin, while the second basic clock CKBout changes in accordance with the first basic clock CKAin. The DATAout is outputted in synchronization with the rising and falling of the second basic clock CKBout. Note that the ODD signal is fixed to a voltage of "L" level.

Note that the foregoing description has dealt with the liquid crystal display apparatus adopting a liquid crystal panel as a display panel in the present embodiment. However, the display panel of the present invention is not limited to the liquid crystal panel, provided that the displaying can be carried out by applying to a plurality of pixels the electric signals that vary depending on the data signal. For example, the present invention can use display panels such as an EL panel and a plasma display panel.

As has been described above, a signal transfer system in accordance with the present invention may be provided with a plurality of signal input-output sections that are connected with each other in a cascade manner, in which the signal input-output section of a first stage receives a plurality of signals and consecutively transfers the signals to the signal input-output sections of the following stages in accordance with self-transfer method, characterized in that wherein the signal input-output section includes: (a) first and second clock input sections that receive first and second clock signals, respectively, from the signal input-output section of a previous stage; (b) first and second clock output sections that invert and output the first and second clock signals to the signal input-output section of a next stage; (c) a data input section that receives a data signal from the signal input-output section of the previous stage in accordance with the first clock signal that has been inputted to the first clock input section; and (d) a data output section that outputs the data signal to the signal input-output section of the next stage in accordance with the second clock signal that has been inputted to the second clock input section.

Another signal transfer system in accordance with the present invention may be provided with a plurality of signal input-output sections that are connected with each other in a cascade manner, in which the signal input-output section of a first stage receives a plurality of signals and consecutively transfers the signals to the signal input-output sections of the following stages in accordance with self-transfer method, characterized in that the signal input-output section includes: (a) first and second clock input sections that receive first and second clock signals, respectively, from the signal input-output section of a previous stage; (b) a data input section that receives a data signal from the signal input-output section of a previous stage in accordance with the first clock signal that has been inputted to the first clock input section; (c) a data output section that outputs the data signal to the signal input-output section of a next stage in accordance with the second clock signal that has been inputted to the second clock input section; (d) a first clock output section that outputs the second clock signal to the signal input-output section of the next stage as the first clock signal; and (e) a second clock output section that outputs the first clock signal to the signal input-output section of the next stage as the second clock signal.

The signal transfer system of the present invention may have the arrangement in which the data input section divides the data signal that has been inputted into 2 channels in accordance with the first clock signal, and the data output section returns the data signal that has been divided into 2 channels to 1 channel in accordance with the second clock signal.

With the arrangement, the data signal of 1 channel that has been inputted is divided into 2 channels by the data input section, and the data signal that has been divided into 2 channels is returned to 1 channel by the data output section. This allows to cope with the case where the means, for receiving the data from each signal input-output section, is provided so that the data of 2 channels are inputted.

Further, it is possible to output the data in parallel with respect to the means that receives the data from each signal input-output section. Such a parallel processing allows to secure the required processing speed even when the processing speed of the data processing section in the means for receiving the data is relatively slow.

The transfer system of the present invention may have the arrangement in which the data input section divides the data signal into 2 channels in synchronization with rising and falling edges of the first clock signal, and the data output section synthesizes the data signal, that has been divided into 2 channels, to 1 channel in synchronization with rising and falling edges of the second clock signal.

With the arrangement, in each signal input-output section, the data signal of 1 channel is fetched in synchronization with the rising and falling of the first clock signal so as to be divided into 2 channels. In each signal input-output section, the data signal that has been divided into 2 channels is synthesized to 1 channel in synchronization with rising and falling edges of the second clock signal. Accordingly, even when the data signal should be transferred at a faster speed, the frequency of the first and second clock signals can be half of that required for fetching the data. This allows to fully secure the duty ratio of the frequency of the first and second clock signals, thereby enabling to enlarge the operating frequency and to improve the high reliance. Further, since the frequency of the first and second clock signals can be lowered, it is possible to suppress the problem of the EMI.

The transfer system of the present invention may have the arrangement in which each of the signal input-output sections further includes discrimination means for discriminating whether the signal input-output section is of an odd-numbered stage or of an even-numbered stage.

As described above, since each signal input-output section outputs the inputted first clock signal to the signal input-output section of the next stage as the second clock signal and outputs the inputted second clock signal to the signal input-output section of the next stage as the first clock signal. Namely, the first clock signal or the second clock signal to be inputted to the signal input-output section is selected based on whether the signal input-output section is of an odd-numbered stage or of an even-numbered stage. In contrast, according to the present arrangement, the discrimination means for discriminating whether the signal input-output section is of an odd-numbered stage or of an even-numbered stage is provided. This allows that the similar data transfer processing can be used for all the signal input-output sections by changing the processing relating to the first and second clock signals based on the discrimination result of the discrimination means.

The transfer system of the present invention may have the arrangement in which the first clock output section inverts and outputs the second clock signal to the signal input-output section of the next stage as the first clock signal, and the second clock output section inverts and outputs the first clock signal to the signal input-output section of the next stage as the second clock signal.

With the arrangement, the inputted first clock signal is inverted and outputted as the second clock signal, while the inputted second clock signal is inverted and outputted as the first clock signal. This causes to the neighboring signal input-output sections to cancel the fluctuation of the duty ratio occurred when the first and second clock signals pass through each signal input-output section. This allows to compensate the duty ratio of the clock signals in the multiple cascade connections, thereby enabling that the transfer system operates at a higher frequency.

A signal transfer apparatus, in accordance with the present invention, that is connected in a cascade manner so as to transfer a plurality of signals outputted from a signal transfer apparatus of a previous stage to a signal transfer apparatus of a next stage based on self-transfer method, may be characterized by further having: (a) first and second clock input sections that receive first and second clock signals, respectively, from the signal transfer apparatus of the previous stage; (b) first and second clock output sections that invert and output the first and second clock signals to the signal transfer apparatus of the next stage; (c) a data input section that receives a data signal from the previous stage in accordance with the first clock signal that has been inputted to the first clock input section; and (d) a data output section that outputs the data signal to the signal transfer apparatus of the next stage in accordance with the second clock signal that has been inputted to the second clock input section.

Another signal transfer apparatus in accordance with the present invention that is connected in a cascade manner so as to transfer a plurality of signals outputted from the signal transfer apparatus of a previous stage to the signal transfer apparatus of a next stage based on self-transferring, may be characterized by further having: (a) first and second clock input sections that receive first and second clock signals, respectively, from the signal transfer apparatus of a previous stage; (b) a data input section that receives a data signal from the signal transfer apparatus of a previous stage in accordance with the first clock signal that has been inputted to the first clock input section; (c) a data output section that outputs the data signal to the signal transfer apparatus of a next stage in accordance with the second clock signal that has been inputted to the second clock input section; (d) a first clock output section that outputs the second clock signal to the signal transfer apparatus of the next stage as the first clock signal; and (e) a second clock output section that outputs the first clock signal to the signal transfer apparatus of the next stage as the second clock signal.

The signal transfer apparatus of the present invention may be characterized in that the first clock output section inverts and outputs the second clock signal to the signal transfer apparatus of the next stage as the first clock signal, and the second clock output section inverts and outputs the first clock signal to the signal transfer apparatus of the next stage as the second clock signal.

With the arrangement, the first clock signal is inverted and outputted as the second clock signal, and the second clock signal is inverted and outputted as the first clock signal. This causes the neighboring signal transfer apparatuses to cancel the fluctuation of the duty ratio occurred when the first and second clock signals pass through each signal transfer apparatus. This allows to compensate the duty ratio of the clock signals in the multiple cascade connections, thereby enabling that the transfer system operates at a higher frequency.

A display panel drive apparatus in accordance with the present invention for driving a display panel in which a plurality of pixels are provided and an electric signal is applied to each of the pixels so as to carry out a display, may be provide with any one of the foregoing signal transfer system, and control logic section that receives the data signal from each signal input-output section of the signal transfer system and controls so as to output the electric signal to each pixel in the display panel in accordance with the data signal thus received.

According to the present invention, a display panel drive apparatus for driving a display panel in which a plurality of pixels are provided and an electric signal is applied to each of the pixels so as to carry out a display, may be provided with the signal transfer apparatus and control logic section that receives the data signal from the signal transfer apparatus and controls so as to output the electric signal to each pixel in the display panel in accordance with the data signal thus received.

With the arrangement, since the display panel is provided with a plurality of pixels, it is possible to appropriately transfer the data signal even when the data signal should be transferred at an extremely high speed. This allows to show the good display performance without display defect even to the display panel having many pixels.

A display apparatus in accordance with the present invention may be characterized by having: a display panel in which a plurality of pixels are provided and an electric signal is applied to each of the pixels so as to carry out a display; and any one of the display panel drive apparatus recited.

The display apparatus of the present invention may have the arrangement in which the display panel is a liquid crystal display panel of an active matrix type.

With the arrangement, it is possible to make the liquid crystal display panel of an active matrix type, have the high resolution, that is lightweight, thin, and relatively high in the display quality. Accordingly, it is possible to realize an apparatus such as a liquid crystal display apparatus having a larger screen size.

There are described above novel features which the skilled man will appreciate give rise to advantages. These are each independent aspects of the invention to be covered by the present application, irrespective of whether or not they are included within the scope of the following claims.

What is claimed is:

1. A signal transfer system, comprising a plurality of signal input-output sections that are connected with each other in a cascade manner, in which the signal input-output section of a first stage receives a plurality of signals and consecutively transfers the signals to the signal input-output sections of the following stages in accordance with self-transferring, wherein the signal input-output section includes:

first and second clock input sections that receive first and second clock signals, respectively, from the signal input-output section of a previous stage;

first and second clock output sections that invert and output the first and second clock signals to the signal input-output section of a next stage;

a data input section that receives a data signal from the signal input-output section of the previous stage in accordance with the first clock signal that has been inputted to the first clock input section; and a data output section that outputs the data signal to the signal input-output section of the next stage in accordance with the second clock signal that has been inputted to the second clock input section.

2. The signal transfer system as set forth in claim 1, wherein the data input section divides the data signal that has been inputted into 2 channels in accordance with the first clock signal, and the data output section returns the data signal that has been divided into 2 channels to 1 channel in accordance with the second clock signal.

3. The signal transfer system as set forth in claim 2, wherein the data input section divides the data signal into 2 channels in synchronization with rising and falling edges of the first clock signal, and the data output section synthesizes the data signal, that has been divided into 2 channels, to 1 channel in synchronization with rising and falling edges of the second clock signal.

4. A signal transfer system, comprising a plurality of signal input-output sections that are connected with each other in a cascade manner, in which the signal input-output section of a first stage receives a plurality of signals and consecutively transfers the signals to the signal input-output sections of the following stages in accordance with self-transferring, wherein the signal input-output section includes:

first and second clock input sections that receive first and second clock signals, respectively, from the signal input-output section of a previous stage;

a data input section that receives a data signal from the signal input-output section of a previous stage in accordance with the first clock signal that has been inputted to the first clock input section;

a data output section that outputs the data signal to the signal input-output section of a next stage in accordance with the second clock signal that has been inputted to the second clock input section;

a first clock output section that outputs the second clock signal to the signal input-output section of the next stage as the first clock signal; and a second clock output section that outputs the first clock signal to the signal input-output section of the next stage as the second clock signal.

5. The signal transfer system as set forth in claim 4, wherein the data input section divides the data signal that has been inputted into 2 channels in accordance with the first clock signal, and the data output section returns the data signal that has been divided into 2 channels to 1 channel in accordance with the second clock signal.

6. The signal transfer system as set forth in claim 5, wherein the data input section divides the data signal into 2 channels in synchronization with rising and falling edges of the first clock signal, and the data output section synthesizes the data signal, that has been divided into 2 channels, to 1 channel in synchronization with rising and falling edges of the second clock signal.

7. The signal transfer system as set forth in claim 4, wherein each of the signal input-output sections further includes discrimination means for discriminating whether the signal input-output section is of an odd-numbered stage or of an even-numbered stage.

8. The signal transfer system as set forth in claim 7, wherein the discrimination means discriminates whether the signal input-output section is of an odd-numbered stage or of an even-numbered stage in accordance with an inputted voltage.

9. The signal transfer system as set forth in claim 4, wherein the first clock output section inverts and outputs the second clock signal to the signal input-output section of the next stage as the first clock signal, and the second clock output section inverts and outputs the first clock signal to the signal input-output section of the next stage as the second clock signal.

10. A signal transfer apparatus, that is connected in a cascade manner so as to transfer a plurality of signals outputted from a signal transfer apparatus of a previous stage to a signal transfer apparatus of a next stage based on self-transferring, further comprising:

first and second clock input sections that receive first and second clock signals, respectively, from the signal transfer apparatus of the previous stage;

first and second clock output sections that invert and output the first and second clock signals to the signal transfer apparatus of the next stage;

a data input section that receives a data signal from the previous stage in accordance with the first clock signal that has been inputted to the first clock input section; and a data output section that outputs the data signal to the signal transfer apparatus of the next stage in accordance with the second clock signal that has been inputted to the second clock input section.

11. The signal transfer system as set forth in claim 10, wherein the data input section divides the data signal that has been inputted into 2 channels in accordance with the first clock signal, and the data output section returns the data signal that has been divided into 2 channels to 1 channel in accordance with the second clock signal.

12. The signal transfer system as set forth in claim 11, wherein the data input section divides the data signal into 2 channels in synchronization with rising and falling edges of the first clock signal, and the data output section synthesizes the data signal, that has been divided into 2 channels, to 1 channel in synchronization with rising and falling edges of the second clock signal.

13. A signal transfer apparatus, that is connected in a cascade manner so as to transfer a plurality of signals outputted from the signal transfer apparatus of a previous stage to the signal transfer apparatus of a next stage based on self-transferring, further comprising:

first and second clock input sections that receive first and second clock signals, respectively, from the signal transfer apparatus of a previous stage;

a data input section that receives a data signal from the signal transfer apparatus of a previous stage in accordance with the first clock signal that has been inputted to the first clock input section;

a data output section that outputs the data signal to the signal transfer apparatus of a next stage in accordance with the second clock signal that has been inputted to the second clock input section;

a first clock output section that outputs the second clock signal to the signal transfer apparatus of the next stage as the first clock signal; and a second clock output section that outputs the first clock signal to the signal transfer apparatus of the next stage as the second clock signal.

14. The signal transfer apparatus as set forth in claim 13, wherein the data input section divides the data signal that has been inputted into 2 channels in accordance with the first clock signal, and the data output section returns the data signal that has been divided into 2 channels to 1 channel in accordance with the second clock signal.

15. The signal transfer apparatus as set forth in claim 14, wherein the data input section divides the data signal into 2 channels in synchronization with rising and falling edges of the first clock signal, and the data output section synthesizes the data signal, that has been divided into 2 channels, to 1 channel in synchronization with rising and falling edges of the second clock signal.

16. The signal transfer apparatus as set forth in claim 13, wherein each of the signal input-output sections further includes discrimination means for discriminating whether the signal input-output section is of an odd-numbered stage or of an even-numbered stage.

17. The signal transfer apparatus as set forth in claim 16, wherein the discrimination means discriminates whether the signal input-output section is of an odd-numbered stage or of an even-numbered stage in accordance with an inputted voltage.

18. The signal transfer apparatus as set forth in claim 13, wherein the first clock output section inverts and outputs the second clock signal to the signal transfer apparatus of the next stage as the first clock signal, and the second clock output section inverts and outputs the first clock signal to the signal transfer apparatus of the next stage as the second clock signal.

19. A display panel drive apparatus for driving a display panel in which a plurality of pixels are provided and an electric signal is applied to each of the pixels so as to carry out a display, comprising:

a signal transfer system; and control logic section that receives the data signal from each signal input-output section of the signal transfer system and controls so as to output the electric signal to each pixel in the display panel in accordance with the data signal thus received, said signal transfer system including a plurality of signal input-output sections that are connected with each other in a cascade manner, in which the signal input-output section of a first stage receives a plurality of signals and consecutively transfers the signals to the signal input-output sections of the following stages in accordance with self-transferring, and said signal input-output section including:

first and second clock input sections that receive first and second clock signals, respectively, from the signal input-output section of a previous stage;

first and second clock output sections that invert and output the first and second clock signals to the signal input-output section of a next stage;

a data input section that receives a data signal from the signal input-output section of the previous stage in accordance with the first clock signal that has been inputted to the first clock input section; and a data output section that outputs the data signal to the signal input-output section of the next stage in accordance with the second clock signal that has been inputted to the second clock input section.

20. A display panel drive apparatus for driving a display panel in which a plurality of pixels are provided and an electric signal is applied to each of the pixels so as to carry out a display, comprising:

a signal transfer system; and control logic section that receives the data signal from each signal input-output section of the signal transfer system and controls so as to output the electric signal to each pixel in the display panel in accordance with the data signal thus received, said signal transfer system including a plurality of signal input-output sections that are connected with each other in a cascade manner, in which the signal input-output section of a first stage receives a plurality of signals and consecutively transfers the signals to the signal input-output sections of the following stages in accordance with self-transferring, and said signal input-output section including:

first and second clock input sections that receive first and second clock signals, respectively, from the signal input-output section of a previous stage;

a data input section that receives a data signal from the signal input-output section of a previous stage in accordance with the first clock signal that has been inputted to the first clock input section;

a data output section that outputs the data signal to the signal input-output section of a next stage in accordance with the second clock signal that has been inputted to the second clock input section;

a first clock output section that outputs the second clock signal to the signal input-output section of the next stage as the first clock signal; and a second clock output section that outputs the first clock signal to the signal input-output section of the next stage as the second clock signal.

21. A display panel drive apparatus for driving a display panel in which a plurality of pixels are provided and an electric signal is applied to each of the pixels so as to carry out a display, comprising:

a signal transfer apparatus; and control logic section that receives the data signal from each signal input-output section of the signal transfer system and controls so as to output the electric signal to each pixel in the display panel in accordance with the data signal thus received, said signal transfer apparatus being connected in a cascade manner so as to transfer a plurality of signals outputted from a signal transfer apparatus of a previous stage to a signal transfer apparatus of a next stage based on self-transferring, and said signal transfer apparatus including:

first and second clock input sections that receive first and second clock signals, respectively, from the signal transfer apparatus of the previous stage;

first and second clock output sections that invert and output the first and second clock signals to the signal transfer apparatus of the next stage;

a data input section that receives a data signal from the signal transfer apparatus of the previous stage in accordance with the first clock signal that has been inputted to the first clock input section; and a data output section that outputs the data signal to the signal transfer apparatus of the next stage in accordance with the second clock signal that has been inputted to the second clock input section.

22. A display panel drive apparatus for driving a display panel in which a plurality of pixels are provided and an electric signal is applied to each of the pixels so as to carry out a display, comprising:

a signal transfer apparatus; and control logic section that receives the data signal from each signal input-output section of the signal transfer system and controls so as to output the electric signal to each pixel in the display panel in accordance with the data signal thus received, said signal transfer apparatus being connected in a cascade manner so as to transfer a plurality of signals outputted from a signal transfer apparatus of a previous stage to a signal transfer apparatus of a next stage based on self-transferring, and said signal transfer apparatus including:

first and second clock input sections that receive first and second clock signals, respectively, from the signal transfer apparatus of a previous stage;

a data input section that receives a data signal from the signal transfer apparatus of a previous stage in accordance with the first clock signal that has been inputted to the first clock input section;

a data output section that outputs the data signal to the signal transfer apparatus of a next stage in accordance with the second clock signal that has been inputted to the second clock input section;

a first clock output section that outputs the second clock signal to the signal transfer apparatus of the next stage as the first clock signal; and a second clock output section that outputs the first clock signal to the signal transfer apparatus of the next stage as the second clock signal.

23. A display apparatus, comprising:

a display panel in which a plurality of pixels are provided and an electric signal is applied to each of the pixels so as to carry out a display; and a display panel drive apparatus for driving the display panel, said display panel drive apparatus including;

a signal transfer system; and control logic section that receives the data signal from each signal input-output section of the signal transfer system and controls so as to output the electric signal to each pixel in the display panel in accordance with the data signal thus received, said signal transfer system including a plurality of signal input-output sections that are connected with each other in a cascade manner, in which the signal input-output section of a first stage receives a plurality of signals and consecutively transfers the signals to the signal input-output sections of the following stages in accordance with self-transferring, and said signal transfer system further including:

first and second clock input sections that receive first and second clock signals, respectively, from the signal input-output section of a previous stage;

first and second clock output sections that invert and output the first and second clock signals to the signal input-output section of a next stage;

a data input section that receives a data signal from the signal input-output section of the previous stage in accordance with the first clock signal that has been inputted to the first clock input section; and a data output section that outputs the data signal to the signal input-output section of the next stage in accordance with the second clock signal that has been inputted to the second clock input section.

24. The display apparatus as set forth in claim 23, wherein the display panel is a liquid crystal display panel of an active matrix type.

25. A display apparatus, comprising:

a display panel in which a plurality of pixels are provided and an electric signal is applied to each of the pixels so as to carry out a display; and a display panel drive apparatus for driving the display panel, said display panel drive apparatus including:

a signal transfer system; and control logic section that receives the data signal from each signal input-output section of the signal transfer system and controls so as to output the electric signal to each pixel in the display panel in accordance with the data signal thus received, said signal transfer system including a plurality of signal input-output sections that are connected with each other in a cascade manner, in which the signal input-output section of a first stage receives a plurality of signals and consecutively transfers the signals to the signal input-output sections of the following stages in accordance with self-transferring, and said signal input-output section including:

first and second clock input sections that receive first and second clock signals, respectively, from the signal input-output section of a previous stage;

a data input section that receives a data signal from the signal input-output section of a previous stage in accordance with the first clock signal that has been inputted to the first clock input section;

a data output section that outputs the data signal to the signal input-output section of a next stage in accordance with the second clock signal that has been inputted to the second clock input section;

a first clock output section that outputs the second clock signal to the signal input-output section of the next stage as the first clock signal; and a second clock output section that outputs the first clock signal to the signal input-output section of the next stage as the second clock signal.

26. The display apparatus as set forth in claim 25, wherein the display panel is a liquid crystal display panel of an active matrix type.

27. A display apparatus, comprising:

a display panel in which a plurality of pixels are provided and an electric signal is applied to each of the pixels so as to carry out a display; and a display panel drive apparatus for driving the display panel, said display panel drive apparatus including:

a signal transfer apparatus; and control logic section that receives the data signal from each signal input-output section of the signal transfer system and controls so as to output the electric signal to each pixel in the display panel in accordance with the data signal thus received, said signal transfer apparatus, that is connected in a cascade manner so as to transfer a plurality of signals outputted from a signal transfer apparatus of a previous stage to a signal transfer apparatus of a next stage based on self-transferring, and said signal transfer apparatus further including:

first and second clock input sections that receive first and second clock signals, respectively, from the signal transfer apparatus of the previous stage;

first and second clock output sections that invert and output the first and second clock signals to the signal transfer apparatus of the next stage;

a data input section that receives a data signal from the signal transfer apparatus of the previous stage in accordance with the first clock signal that has been inputted to the first clock input section; and a data output section that outputs the data signal to the signal transfer apparatus of the next stage in accordance with the second clock signal that has been inputted to the second clock input section.

28. The display apparatus as set forth in claim 27, wherein the display panel is a liquid crystal display panel of an active matrix type.

29. A display apparatus, comprising:

a display panel in which a plurality of pixels are provided and an electric signal is applied to each of the pixels so as to carry out a display; and a display panel drive apparatus for driving the display panel, said display panel drive apparatus including:

a signal transfer apparatus; and control logic section that receives the data signal from each signal input-output section of the signal transfer system and controls so as to output the electric signal to each pixel in the display panel in accordance with the data signal thus received, said signal transfer apparatus being connected in a cascade manner so as to transfer a plurality of signals outputted from a signal transfer apparatus of a previous stage to a signal transfer apparatus of a next stage based on self-transferring, and said signal transfer apparatus including:

first and second clock input sections that receive first and second clock signals, respectively, from the signal transfer apparatus of a previous stage;

a data input section that receives a data signal from the signal transfer apparatus of a previous stage in accordance with the first clock signal that has been inputted to the first clock input section;

a data output section that outputs the data signal to the signal transfer apparatus of a next stage in accordance with the second clock signal that has been inputted to the second clock input section;

a first clock output section that outputs the second clock signal to the signal transfer apparatus of the next stage as the first clock signal; and a second clock output section that outputs the first clock signal to the signal transfer apparatus of the next stage as the second clock signal.

30. The display apparatus as set forth in claim 29, wherein the display panel is a liquid crystal display panel of an active matrix type.

* * * * *